US009233382B2

(12) United States Patent
Ossian et al.

(10) Patent No.: US 9,233,382 B2
(45) Date of Patent: Jan. 12, 2016

(54) LIQUID SPRAYING APPARATUS

(75) Inventors: Michael P. Ossian, DeWitt, IA (US); Kenneth C. Ossian, Bettendorf, IA (US); Chester F. Robards, Jr., Flora, MS (US); Kerry D. Roosmalen, Madison, MS (US)

(73) Assignee: OSSIAN, INC., Davenport, IA (US)

( * ) Notice: Subject to any disclaimer, the term of this patent is extended or adjusted under 35 U.S.C. 154(b) by 1985 days.

(21) Appl. No.: 12/157,522

(22) Filed: Jun. 11, 2008

(65) Prior Publication Data

US 2008/0245894 A1 Oct. 9, 2008

Related U.S. Application Data

(63) Continuation-in-part of application No. 11/828,881, filed on Jul. 26, 2007, now abandoned.

(60) Provisional application No. 60/820,530, filed on Jul. 27, 2006.

(51) Int. Cl.
*B05B 9/00* (2006.01)
*B05B 1/20* (2006.01)
(Continued)

(52) U.S. Cl.
CPC . *B05B 9/007* (2013.01); *B05B 1/20* (2013.01); *E01H 5/04* (2013.01); *E01H 10/007* (2013.01)

(58) Field of Classification Search
CPC ..... B05B 9/007; B05B 1/20; E01H 5/04; E01H 10/007
USPC ..... 239/146, 147, 159, 164, 166, 167, 168, 239/170, 176, 330, 722, 754; 403/92, 93, 403/94, 95
See application file for complete search history.

(56) References Cited

U.S. PATENT DOCUMENTS 4,865,255 A 9/1989 Lavisotto
4,955,538 A * 9/1990 Laube et al. ..... 239/1
(Continued)

FOREIGN PATENT DOCUMENTS

DE 40 11 057 A1 10/1991
DE 4011057 A1 * 10/1991
(Continued)

OTHER PUBLICATIONS

"Landscaper" Photograph.
(Continued)

*Primary Examiner* — Ryan Reis
(74) *Attorney, Agent, or Firm* — John R. Hoffman

(57) ABSTRACT

A liquid spraying apparatus includes a chassis having a front, a rear, opposite sides and a handle generally at the rear of the chassis. Wheels are rotatably mounted on the chassis for moving the spraying apparatus in a path over a subjacent surface. A tank is mounted on the chassis for holding liquid to be sprayed. An elongated spray boom is mounted at least at one side of the chassis. The boom has an inner end pivotally mounted to the chassis for movement of an outer end in a generally horizontal plane between an outboard position projecting outwardly of the chassis and an inboard position generally alongside the chassis. At least one spray nozzle is provided on the boom. Conduits are provided for feeding liquid from the tank to the nozzle. Positioning detents are provided for holding the boom in at least one intermediate position between the outboard and inboard positions to vary the width of the spray pattern as the apparatus is moved in the path over the subjacent surface.

17 Claims, 20 Drawing Sheets

(51) Int. Cl.
*E01H 5/04* (2006.01)
*E01H 10/00* (2006.01)

(56) References Cited

U.S. PATENT DOCUMENTS

| | | | | | |
|---|---|---|---|---|---|
| 4,962,892 | A * | 10/1990 | Sauer | 239/722 |
| 5,312,043 | A * | 5/1994 | Whitney | 239/754 |
| 5,810,213 | A | 9/1998 | Flores et al. | |
| 6,099,097 | A * | 8/2000 | Hocker et al. | 312/327 |
| 6,279,838 | B1 | 8/2001 | Sivells et al. | |
| 6,805,304 | B1 | 10/2004 | Nokes et al. | |
| 7,152,812 | B1 * | 12/2006 | Johnson | 239/164 |
| 7,419,127 | B2 * | 9/2008 | Buehler | 248/292.12 |
| 2004/0084552 | A1 * | 5/2004 | Huartson | 239/146 |
| 2005/0248150 | A1 | 11/2005 | Gilpatrick et al. | |
| 2008/0048049 | A1 * | 2/2008 | Adams et al. | 239/146 |

FOREIGN PATENT DOCUMENTS

| | | | |
|---|---|---|---|
| EP | 0 178 085 | A1 | 4/1986 |
| EP | 1 134 029 | A2 | 9/2001 |
| GB | 2 352 148 | A | 1/2001 |

OTHER PUBLICATIONS

"Demco" Photograph.
"Sprayer Kit" Photograph.

* cited by examiner

LIQUID SPRAYING APPARATUS

CROSS-REFERENCE TO RELATED APPLICATIONS

This application claims the benefit of the filing date of earlier filed provisional application Ser. No. 60/820,530 of Jul. 27, 2006, entitled LIQUID SPREADER FOR DE-ICING SIDEWALKS AND STEPS, and which application is hereby incorporated by reference in its entirety.

This application is a continuation-in-part of Ser. No. 11/828,881 which was filed on Jul. 26, 2007, and assigned to the assignee of this application.

FIELD OF THE INVENTION

The present invention generally relates to a liquid spraying apparatus. Although the application has particular applicability for spraying liquid de-icer, certain aspects of the invention have applicability for spraying other liquid material.

BACKGROUND OF THE INVENTION

The use of liquid de-icer compositions is known. Some prefer liquid de-icers over solid form pellets, since liquids have unique melting properties and spread easier than dry products. However, the application process for liquid de-icers can often be difficult for the operator. Currently application methods center around use of heavy manual pump fertilizer sprayers, carried in one hand or carried in a back harness, and applied with a hand wand. These are not satisfactory for winter use for a variety of reasons. The operator needs to stop regularly to repump the sprayer. They also have capacity and weight issues, making this unappealing, particularly in the winter when standing in the cold, on ice. Even further compounding the problem is that liquid de-icer chemicals are heavy, typically running eleven or more pounds per gallon. This makes wand application over long stretches of sidewalk or driveways difficult and tiring.

In order to overcome these deficiencies, there have been some efforts at developing mobile sprayers for de-icing sidewalks and steps that may be pushed like a lawn mower while using battery powered spray systems. People trying this approach have simply turned to lawn and garden sprayers mounted much like an engine is mounted on a hand push lawn mower chassis. However, there are certain design and environmental condition requirements encountered by de-icing spray systems in the wintertime that simply make adaptation of a conventional lawn mower chassis to a de-icer spray system using a tank, ill-suited for best de-icer needs.

Among the problems that occur are those resulting from the winter conditions, the weight of the de-icer, and metal corrosion. With the goal of the sprayer to be easily maneuvered on ice and snow covered paved areas for controlled spray patterns, there is a need to address the proper arrangement necessary to achieve this; at the same time there must be some sort of braking system to allow one to let the unit sit motionless while acting as a pump station to power a spray wand use. The operator must be confident that it will not simply roll away on an inclined or icy surface.

Moreover, additional problems are found with the spray bars or booms that are typically used in the front of mobile sprayers, such as agricultural sprayers. They often get in the way, either because they are not needed for the particular application, or they are needed in a slightly different configuration than a fixed bar, which is typical. There is therefore a need for a collapsible spray boom hinged in two points off the front corners of the de-icer sprayer chassis which may expand or unfold like wings of a folding tool bar. They can then be selectively and independently moved from an operable position to an inoperable position or anywhere in between.

Another problem with conventional agricultural use sprayers using hand wands is an erratic spray pattern, meaning that some areas get skipped. There is a need for a unit that therefore has both adjustable spray booms for uniform application and as optional for the user, a hand wand to get at difficult places not reachable by the booms.

Another difficulty sometimes encountered with a lawn mower-type chassis that has spray booms attached to the front is that the booms themselves can get in the way; they therefore need to be selectively moveable from operational or extended positions to non-operable collapsed, storage positions.

Yet another issue with conventional agricultural sprayers when used for de-icers is that the pump system must be shielded and isolated from the often difficult environmental conditions such as moisture, corrosive effects of de-icer salts, and snow and ice that may cause pump operation difficulties.

Another need is to have a mobile unit which can have an easily removed quick change tank with a push/pull connection and one which has the hose and pumping system, as well as its electrical system all operating under cover, protected from the difficult winter environment.

The solving of the above problems and needs, specific to de-icer application systems, as opposed to using boomed agricultural systems, portable pump sprayers or backpacks can be achieved by use of the system of the present invention. It uses alternately and selectively in combination collapsible wing sprayers, the use of a hand held wand, the use of a chassis brake, environmentally protected power and pump components, and a quick change with a push/pull connection tank. The invention therefore addresses these specific needs and perhaps others, all unique to de-icer spray systems, as opposed to conventional lawn and garden sprayers. It therefore can be seen that the invention solves the stated problems and needs and represents an advance and improvement for the de-icing industry.

SUMMARY OF THE INVENTION

An object, therefore, of the invention is to provide a new and improved liquid spraying apparatus.

In the exemplary embodiment of the invention, a liquid spraying apparatus includes a chassis having a front, a rear, opposite sides and a handle generally at the rear of the chassis. Wheels are rotatably mounted on the chassis for moving the spraying apparatus in a path over a subjacent surface. A tank is mounted on the chassis for holding liquid to be sprayed. An elongated spray boom is mounted at least at one side of the chassis. The boom has an inner end pivotally mounted to the chassis for movement of an outer end in a generally horizontal plane between an outboard position projecting outwardly of the chassis and an inboard position generally alongside the chassis. At least one spray nozzle is provided on the boom. Conduit means are provided for feeding liquid from the tank to the nozzle. Positioning means are provided for holding the boom in at least one intermediate position between the outboard and inboard positions to vary the width of the spray pattern as the apparatus is moved in the path over the subjacent surface.

As disclosed herein, two of the spray booms are pivotally mounted at the opposite sides of the chassis and having respective nozzles. The nozzles are located near the outer ends of the booms.

According to one aspect of the invention, detent means are provided for positively holding the boom in at least one discrete intermediate position between the outboard and inboard positions. The detent means may be located at the handle of the apparatus. The detent means may include a plurality of detents for positively holding the boom in a plurality of discrete intermediate positions between the outboard and inboard positions.

The boom is pivotally mounted to the chassis at a hub. A slip clutch is provided in the hub to allow the boom to pivot independently of the positioning means in the event that the boom accidentally strikes a foreign object.

In the exemplary embodiment, at least one fixed spray nozzle is mounted at the front end of the chassis, with conduit means for feeding liquid from the tank to the fixed nozzle.

According to another aspect of the invention, the booms are pivotally mounted to the chassis for movement in a horizontal plane between outboard positions to inboard positions in a forward and rearward direction. Therefore, the booms can be pushed rearwardly if accidentally engaging a foreign object, as the apparatus moves forwardly, without damaging the booms.

According to a further aspect of the invention, releasable latch means are provided between the inner end of each boom and the chassis to allow the boom to be readily removed for repair of replacement purposes. Preferably, the releasable latch means comprise snap latch means to allow the boom to be pivotally mounted without tools. In the exemplary embodiment of the invention, the snap latch means comprise at least one flexible latch arm. Preferably, the flexible latch arm is fabricated of frangible plastic material so that the latch arm will break under the influence of excessive external forces on the boom and, thereby, prevent damage to other parts of the apparatus. As disclosed herein, the releasable latch means are located in the hub which pivotally mounts the boom to the chassis.

According to still another aspect of the invention, the spray nozzle on the boom or the chassis is considered a first spray nozzle, with a first manually actuatable trigger operatively associated therewith to effect spraying liquid therefrom. A hand spray wand is provided with a second spray nozzle and a second manually actuatable trigger operatively associated therewith to effect spraying liquid therefrom. Conduit means are provided for feeding liquid from the tank to the first and second spray nozzles. Therefore, the liquid can be selectively sprayed from either the first spray nozzle on the boom (or chassis) or the second spray nozzle on the hand wand, or both, by selectively actuating either the first trigger or the second trigger, respectively, or both. As disclosed herein, a pump is provided for pumping the liquid from the tank to the nozzles. First and second valve means are provided in the conduit means and operatively associated with the first and second triggers, respectively, to open and close the conduit means to the first and second nozzles, respectively.

According to still a further aspect of the invention, the tank is removably mounted on the chassis and includes a fill opening. A siphon cap and hose assembly includes a cap for closing the fill opening of the tank. A siphon hose has an outer end and an inner end extends through the cap into the tank for withdrawing liquid therefrom. A quick-disconnect coupling means is provided between the outer end of the siphon hose and a feed end of the conduit means, whereby the tank and the siphon cap and hose assembly all can be conjointly removed from the chassis as a unit when it is necessary to refill or clean the tank. As disclosed herein, the quick-disconnect coupling means comprise complementary interengaging male and female couplings which are structured to be interengageable by a push-pull action. The coupling at the free end of the conduit means is oriented on the chassis whereby the coupling means is connected and disconnected in a generally vertical push-pull direction.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

FIGS. 1-9 shows one embodiment of the present invention. It is understood that the disclosed embodiments are illustrative only and that there are other embodiments that are fully intended to come within the scope of the attached claims. The Applicant therefore intends to rely fully upon the current state of the U.S. Patent Laws as of the time of this filing, including the doctrine of equivalents. It is within the spirit of this understanding that the detailed description is provided. It should also be mentioned that the apparatus may be used to spray liquids other than de-icers, even though it is especially designed for that purpose.

Figure 1:
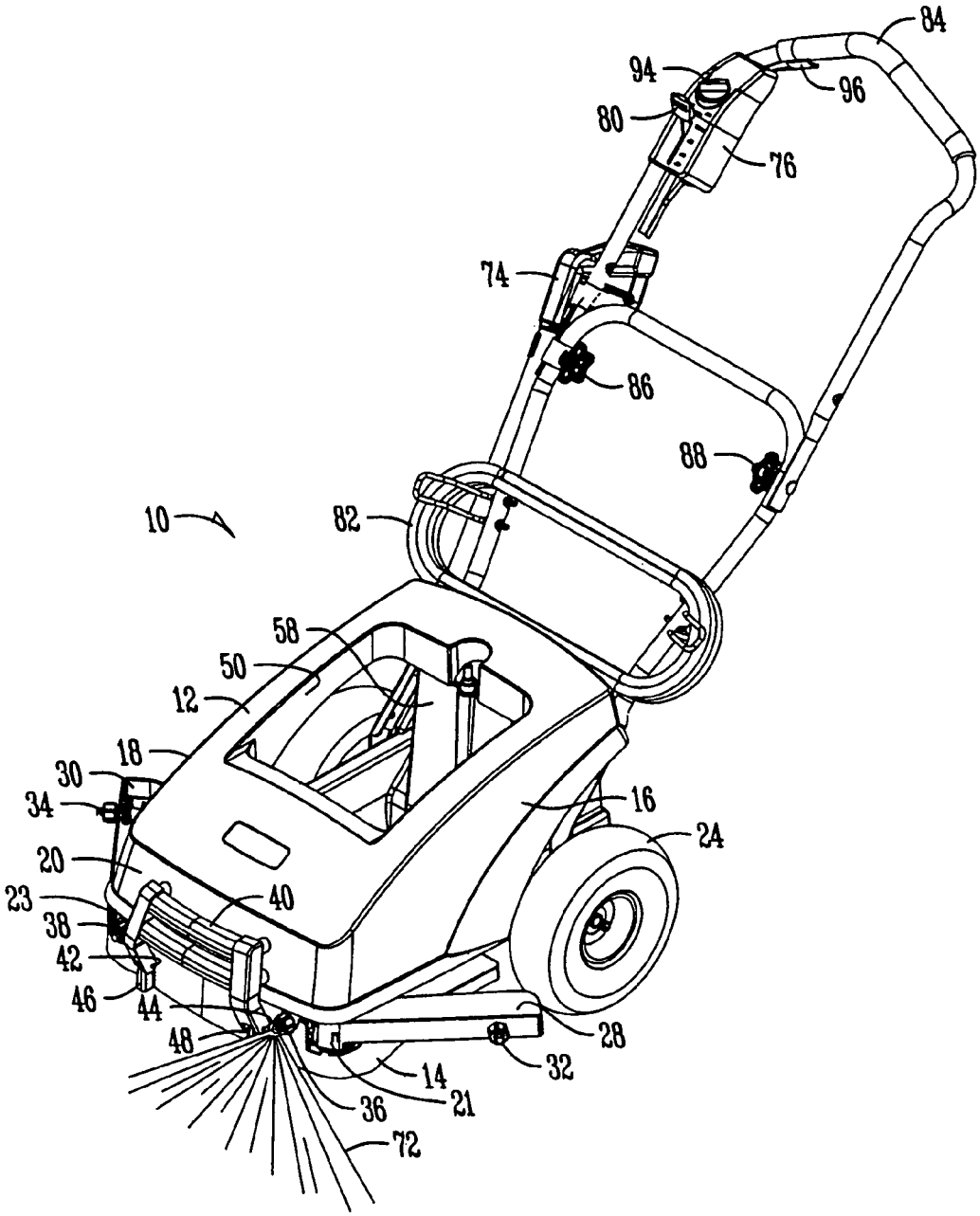
FIG. 1 is a perspective view of one embodiment of the liquid spraying apparatus of the invention, with the quick change tank removed.

Referring to FIG. 1, there is shown in perspective a spraying apparatus 10 which has a cowling or cover 12 which protects the covered battery, plumbing, circuitry and pump from the exterior weather environment. The apparatus 10 has a rigid chassis 14 having sides 16, 18, and a front 20 and rear 22. The chassis 14 is supported by two rear wheels 24, 26 connected adjacent the rear end of the rigid chassis 14, for moving the apparatus over a subjacent surface.

Pivotally mounted hubs at 21 and 23 to the sides 16, 18 of chassis 14 near the front 20 connect the side booms or side spray bars 28, 30. Side spray bars 28 and 30 are snap fit mounted to rigid chassis so that they may be selectively moved between various open operable position (FIG. 2) to a closed or retracted positions where they are parallel to, and underneath the chassis sides 16 and 18.

Mounted to each of the spray bars 28 and 30 are spray nozzles 32, 34 and similarly mounted are fixed spray nozzles 36, 38 on front 20 of chassis 14.

A bumper 40 is attached to the front of cowling 12 and pivotally mounted at 42, 44 to posts 46 and 48 attached to the front 20 of chassis 14. It therefore can be seen that cowling 12 can be pivoted up and forward by pivot points 46, 48 to reveal the interior of the apparatus 10.

Figure 4:
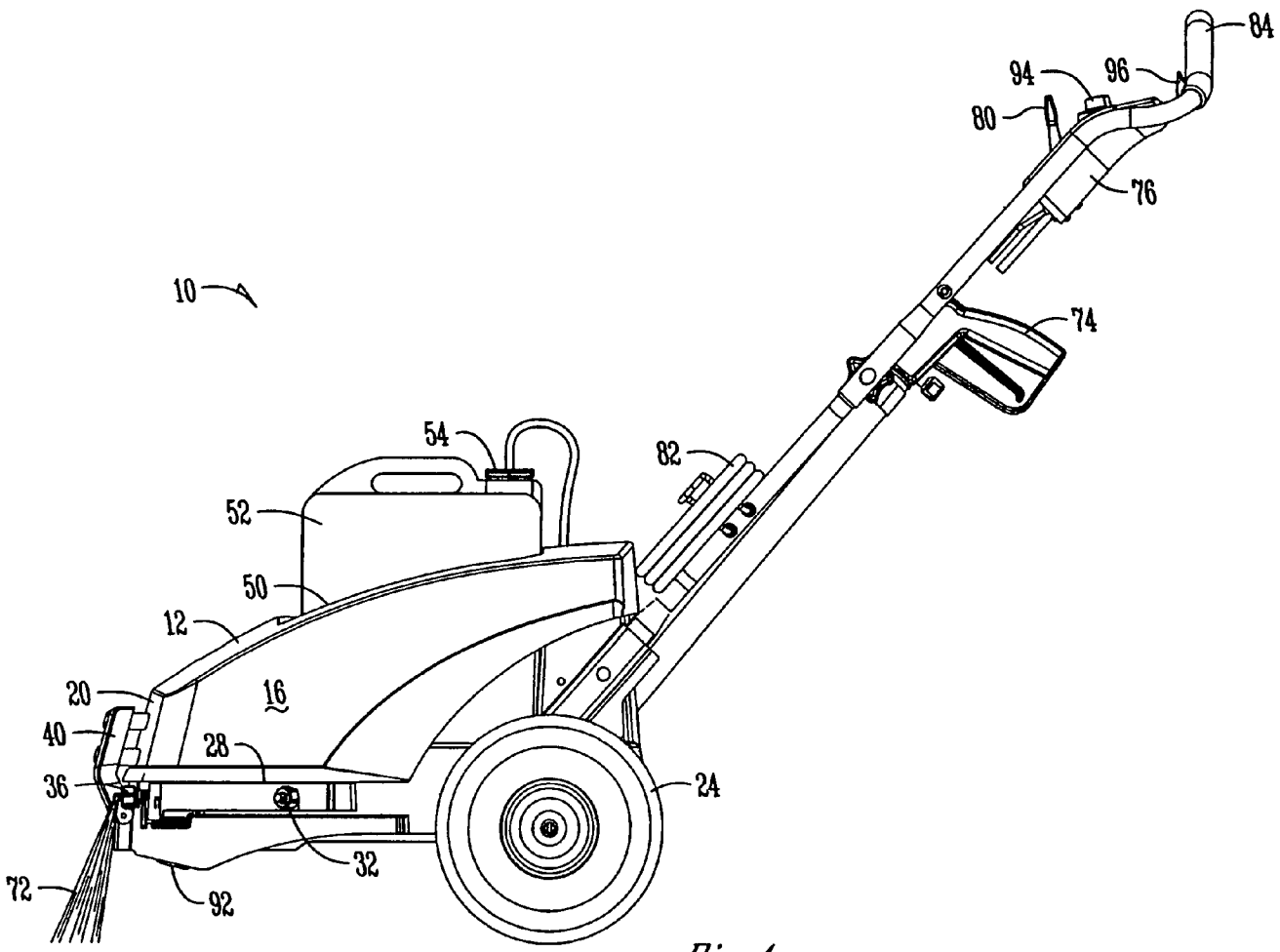
FIG. 4 is a side view of the apparatus.
Figure 5:
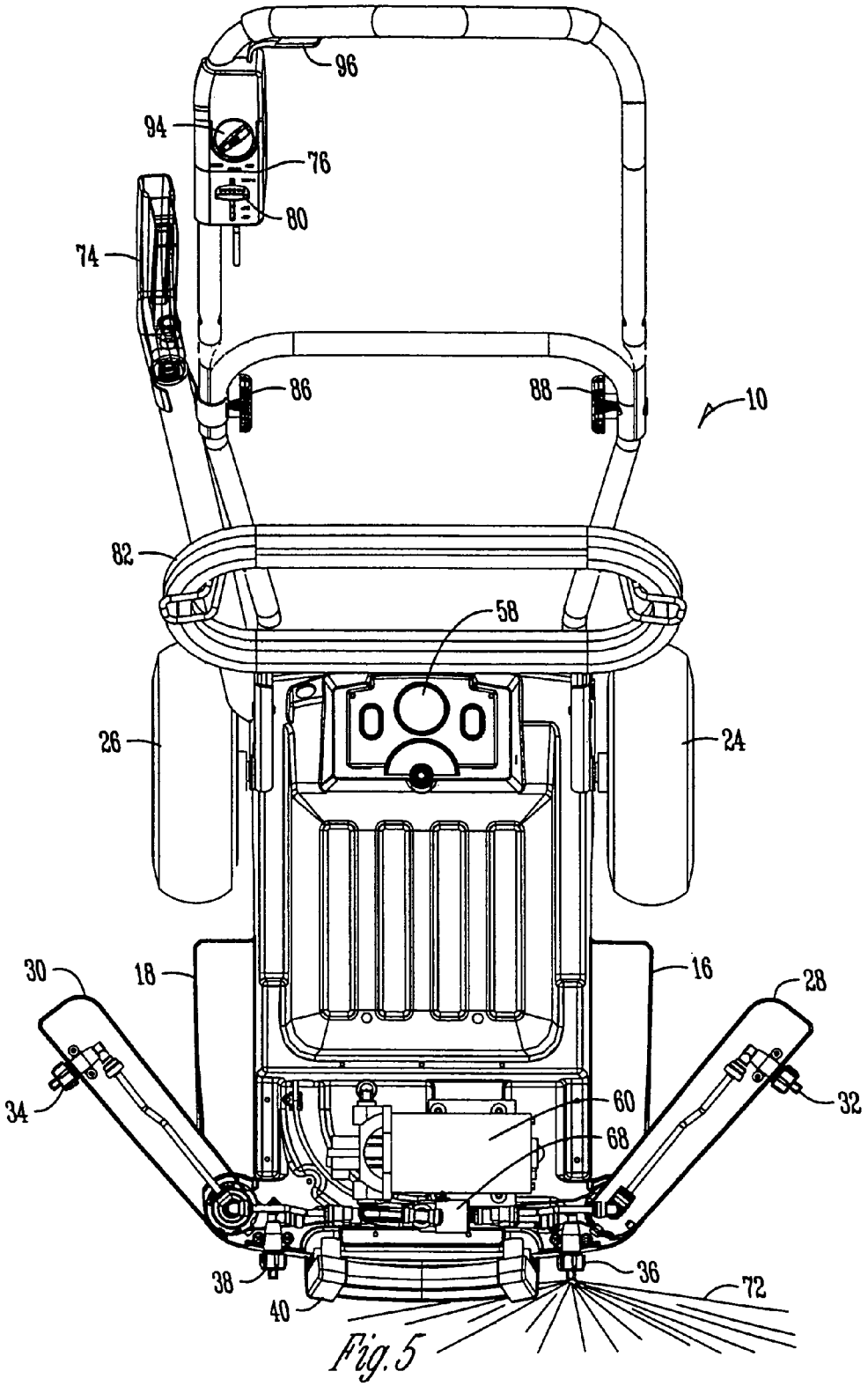
FIG. 5 is a top view of the apparatus of the present invention, with parts broken away to facilitate the illustration.
Figure 6:
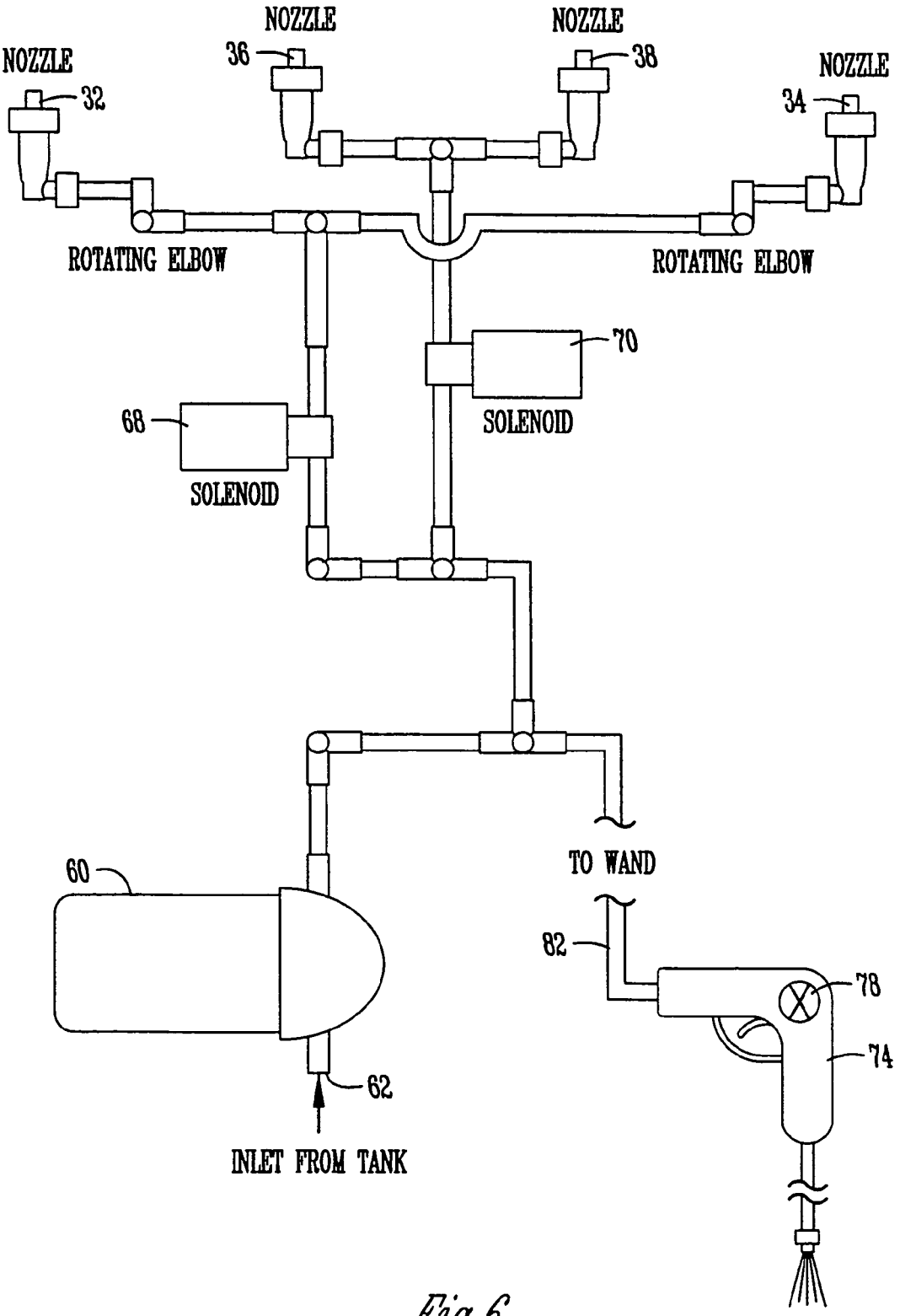
FIG. 6 is a schematic diagram of valving and pump lines showing how one embodiment of the apparatus may be selectively distributed to the fixed front nozzles and those mounted on the spray booms, or to the hand held spray wand.

Cowling or housing 12 has a central opening 50 for holding inert plastic (non-corrosive) tank 52 (FIG. 4). Tank 52 has a screw cap 54 (FIG. 8) with a quick hose connection for fluid line to diaphragm pump 60 (FIG. 5) resting in the forward front portion of the compartment of the housing or cowling 12, the bottom of which is defined by chassis 14. Pump 60 pumps liquid by a pump inlet 62 (FIG. 8) and feed conduit 64, and tank siphon hose 66 to the spray nozzles and wand. Pump 60 action is illustrated with the plumbing circuitry/solenoid valve operation combination in FIG. 6 to demonstrate how fluid is transported to the spray nozzles. FIG. 6 shows how liquid from tank 52 may be directed selectively (depending on which way solenoid valves 68 and 70 operate) to selectively provide liquid spray 72 to the boom nozzles 32, 34 and/or front nozzles 36, 38 or alternatively to hand wand 74 via a manual valve 78 controlled by a trigger 79.

Figure 7:
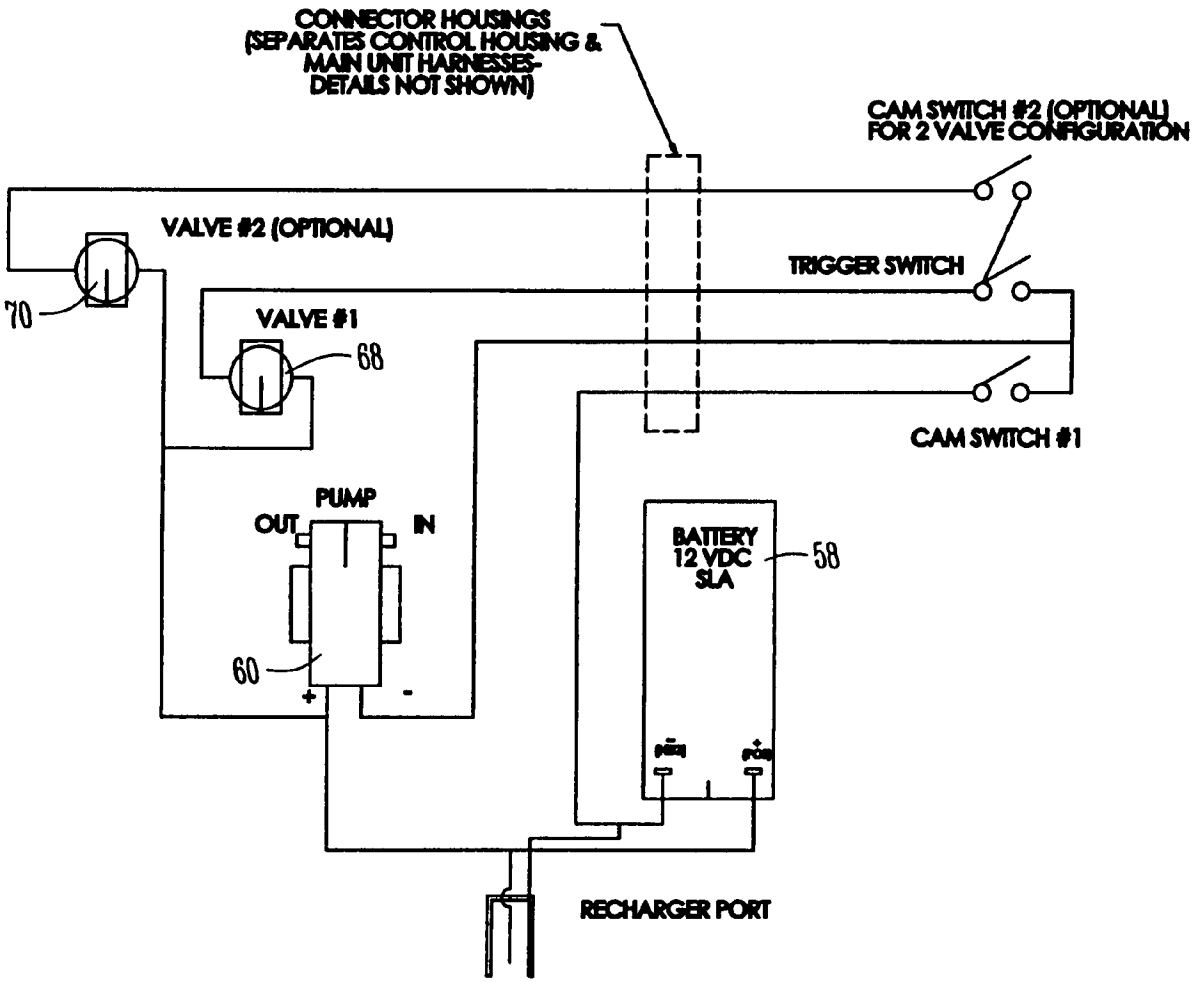
FIG. 7 is a schematic diagram of the electrical system of the one embodiment of the apparatus.
Figure 8:
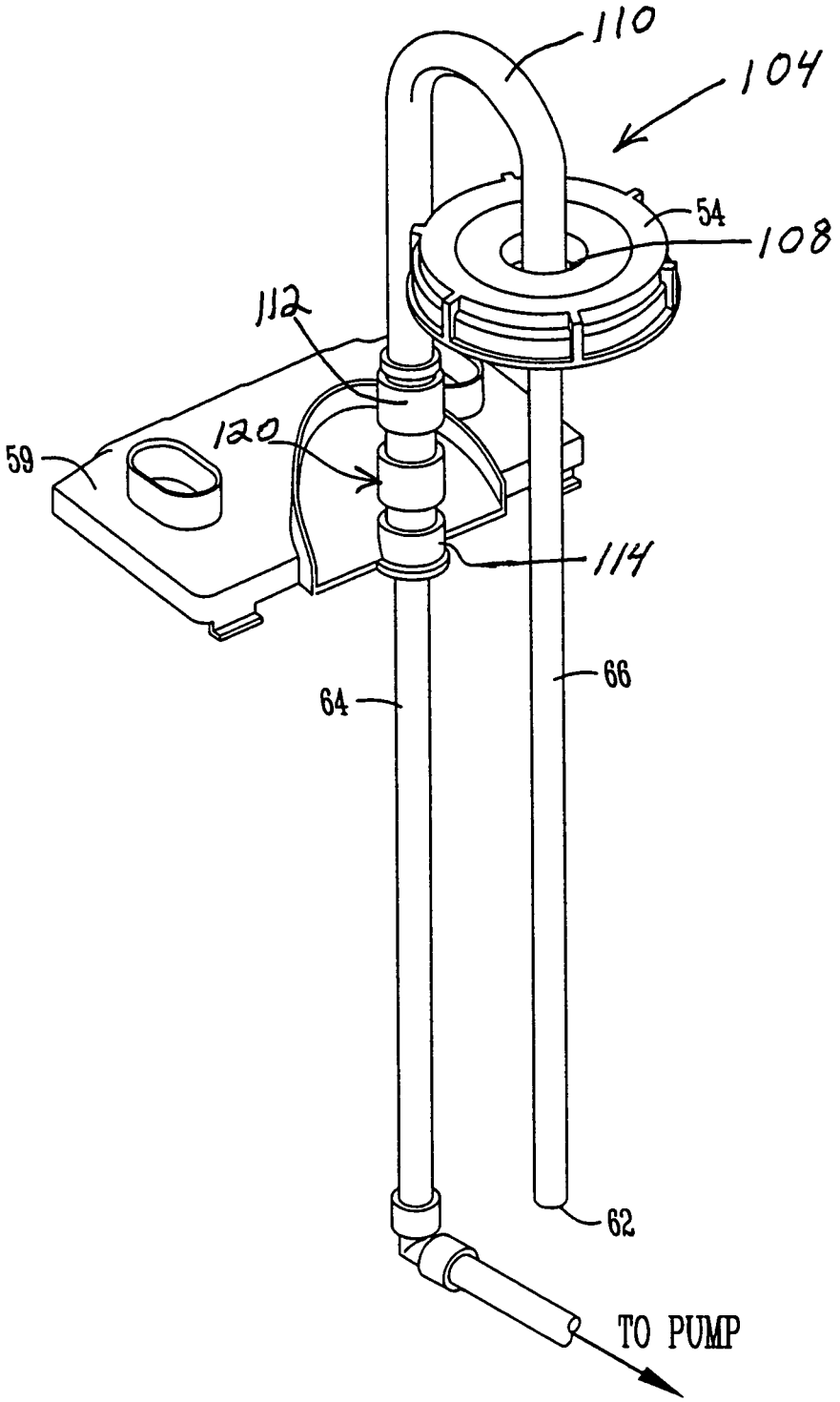
FIG. 8 shows one embodiment of the siphon cap and hose assembly and the battery cover with the quick-disconnect coupling means.

The electrical schematic for selective operation of pump 60, solenoids 68, 70 and valves for the nozzles 32, 34, 36 and 38 or hand wand 74 and user control housing 76 are shown in FIGS. 6 and 7. As can be seen, use of the control housing 76 through the appropriate electrical circuitry illustrated in FIG. 7 will selectively operate pump 60 to pump fluid via solenoid operated valves 68 and 70 to nozzles of booms 32, 34 and front fixed nozzles 36 and 38 respectively, or alternatively, by trigger controlled manual valve 78 sending fluid from tank 52 directly to wand 74.

Figure 2:
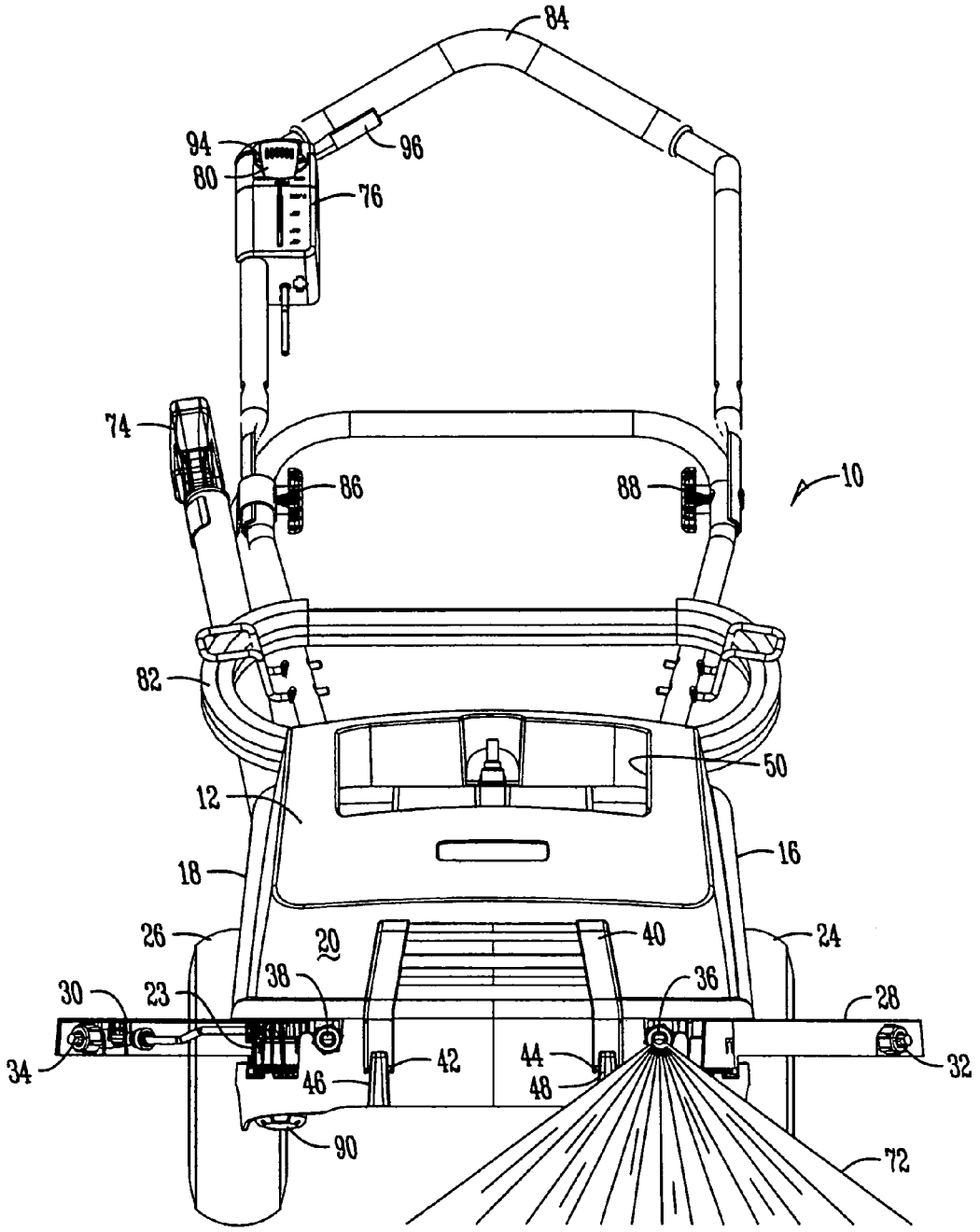
FIG. 2 is a front view of the apparatus of FIG. 1.
Figure 3:
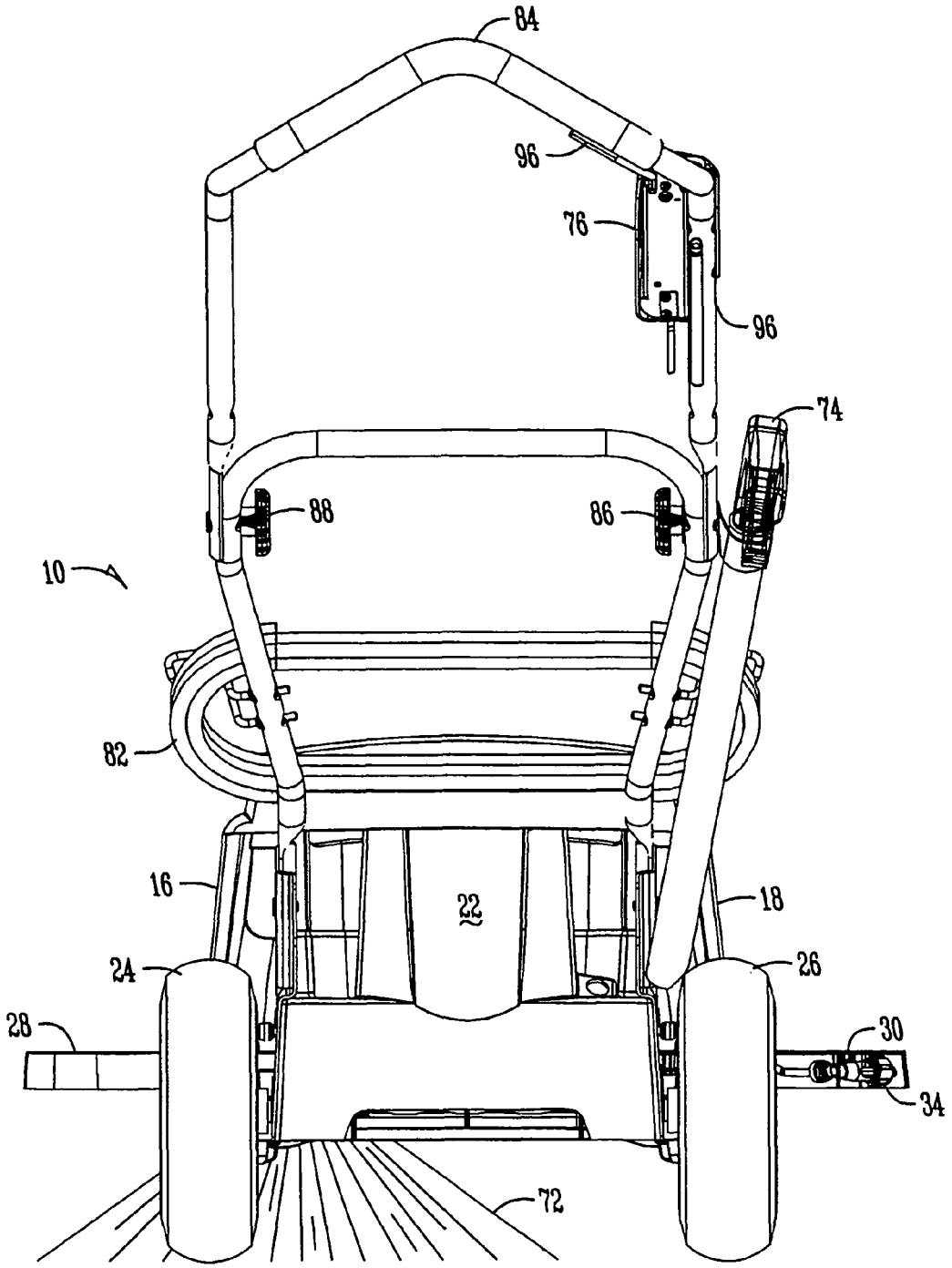
FIG. 3 is a rear view of the apparatus of FIG. 1.

Lever 80 is moveable from a closed position (FIG. 1) to an open position downwardly and forwardly which operates a boom control cable (not depicted) of conventional construction. It is a conventional flexible cable to selectively rotate boom 28 and 30 out into extended or operational position. This cable system allows the operator to selectively extend booms 28 and 30 to the fully extended position as shown in FIG. 2 or something less than that by simple adjustment of lever 80 to accommodate or adjust for varying width sidewalks. As a result, the spray pattern width can be controlled as the operation continues. As illustrated in FIG. 2, both spray booms 28, 30 are selectively extended by use of lever 80; spray booms 28, 30 are correspondingly retracted moving in and closed underneath the chassis via the pivot connection earlier explained upon backward movement of lever 80. Since the details of boom control via flexible cables to extend from extended or out position to in or retracted position are conventional, mechanical contrivances for adjustability well within the routine skill of the art, the specifics of those are not depicted herein. Hose 82 (FIG. 1) is connected to wand 74 to allow the wand 74 to be moved away from the unit 10 to selectively spray difficult to reach locations. Handle 84 is of conventional construction, is used for example on lawn mowers and may be collapsed via screw clamps 86, 88 for convenient storage.

As best illustrated in FIG. 4, the chassis 14 has its associated set of chassis wheels 24, 26 conventionally mounted, but behind the center of gravity of tank 52 to provide a desired handle force for the operator. Stops 90 and 92 (see FIGS. 4 and 5) extend down from the chassis towards the ground to help reduce the tendency of the unit to roll on an incline and provide wear-resistance and balance when moved by an operator when dragging unit by wand hose or other action.

Referring specifically to FIGS. 6 and 7, the following describes the preferred embodiment of the invention:

The user control housing provides the user with a rotary knob 94 and a rotary trigger 96 (lever 96, FIG. 1). The knob has internal cams that activate the switches shown in FIG. 7, and the knob 94 is provided with preferably 3 detent positions in its housing. For clarity, the detented positions may be referred to as OFF, 1, and 2.

When the knob 94 is in the off position, no electrical power flows to the pump 60, or to the two solenoid valves (#1 and #2 of FIG. 7) (solenoid 68, 70 operated) shown in FIG. 7. When the knob is rotated to position 1, cam switch #1 closes, which provides power from the battery 58 to the pump 60 and to the trigger switch. At this point the pump 60 pressurizes the plumbing system in preparation for spraying. If desired, while the rotary knob is in position #1, the manual valve of the spray wand, located within the pistol grip portion of the wand, can be activated by the operator to cause fluid flow to the wand nozzle only.

While the knob 94 is in position 1, the trigger 96 can be activated, which closes the trigger switch, which in turn opens valve #1 which permits fluid to flow to the fixed nozzles 36, 38 only. In this embodiment, this allows the operator to spray a narrow pattern, without liquid waste, or application of excessive amounts of liquid to the desired area.

When the rotary knob 94 is moved to position #2, cam switch #2 is closed. Under this condition, when the trigger is activated, and the trigger switch is closed, valves 1 and 2 are activated which causes liquid to flow to nozzles 38, 40, and 32 and 34.

An alternative embodiment is wherein all valves can be activated when the rotary knob is in position 1, thereby reducing the necessary knob positions to just OFF and 1. As such, valves 1 and 2 can then be replaced by a single valve of appropriate size, if desirable. This will be seen hereinafter.

An additional alternate embodiment might entail moving cam switch #2 so that it is activated by the boom control lever. In such an arrangement, cam switch #2 would be activated only when the booms have been moved from the parked position. This would effectively prevent the boom nozzles from spraying while fully retracted, and would thereby allow the same functionality as the preferred embodiment by a different method.

In the preferred embodiment, the recharge port (FIG. 7) is designed so that when the plug from the recharging device is inserted into the recharger port, all of the electrical devices (pump, valves, and switches) are electrically isolated from the battery. This is to prevent damage to the recharger and/or any of the electrical devices on the unit. In addition, the isolation of the switches prevents inadvertent spraying should the operator activate the trigger during the recharging process.

It should be understood that all of the electrical wiring and liquid conduit means are not shown in the drawings in order to avoid unnecessarily cluttering the depiction. Such wiring and conduits (tubing) is within the skill of a man skilled in this art.

In actual operation, the unit works in the following manner. Tank 52 is filled with liquid and is loaded into and connected to plumbing of unit 10. The unit is switched on, by rotary knob 94 on control housing 76, meaning battery 58 is electrically connected to allow pump 60 to be in operable position and the circuit of FIG. 6. Lever 80 is moved to the desired position so that spray boom arms 28 and 30 are extended and trigger 96 is closed by the operator to open appropriate valves via solenoids 68 and 70 to allow liquid to be pumped to spray nozzles 32, 34, 36 and 38 as determined by position of 94 or other desired positions via pump 60. As a result, since the battery 58 energizes pump 60 when 94 is moved to 1 or 2 position, spray is delivered to by nozzles 32, 34, 36 and 38 in front of the unit 10 as determined by position of knob 94. If spraying is desired to be stopped, trigger 96 is released from its depressed state opening the circuit, closing valves (FIG. 7) via solenoids 68 and 70 and stopping the spray.

Similarly, if one desires to dispense spray via hand wand 74, wand valve 78 is manually opened to allow flow of spray from pump 60 out of wand 74 by way of hose 82. If the unit is desired for storage, lever 80 is pulled back and booms 28 and 30 retracted, handle 84 may be collapsed, tank 52 removed (if desired) and the unit stored.

Figure 10:
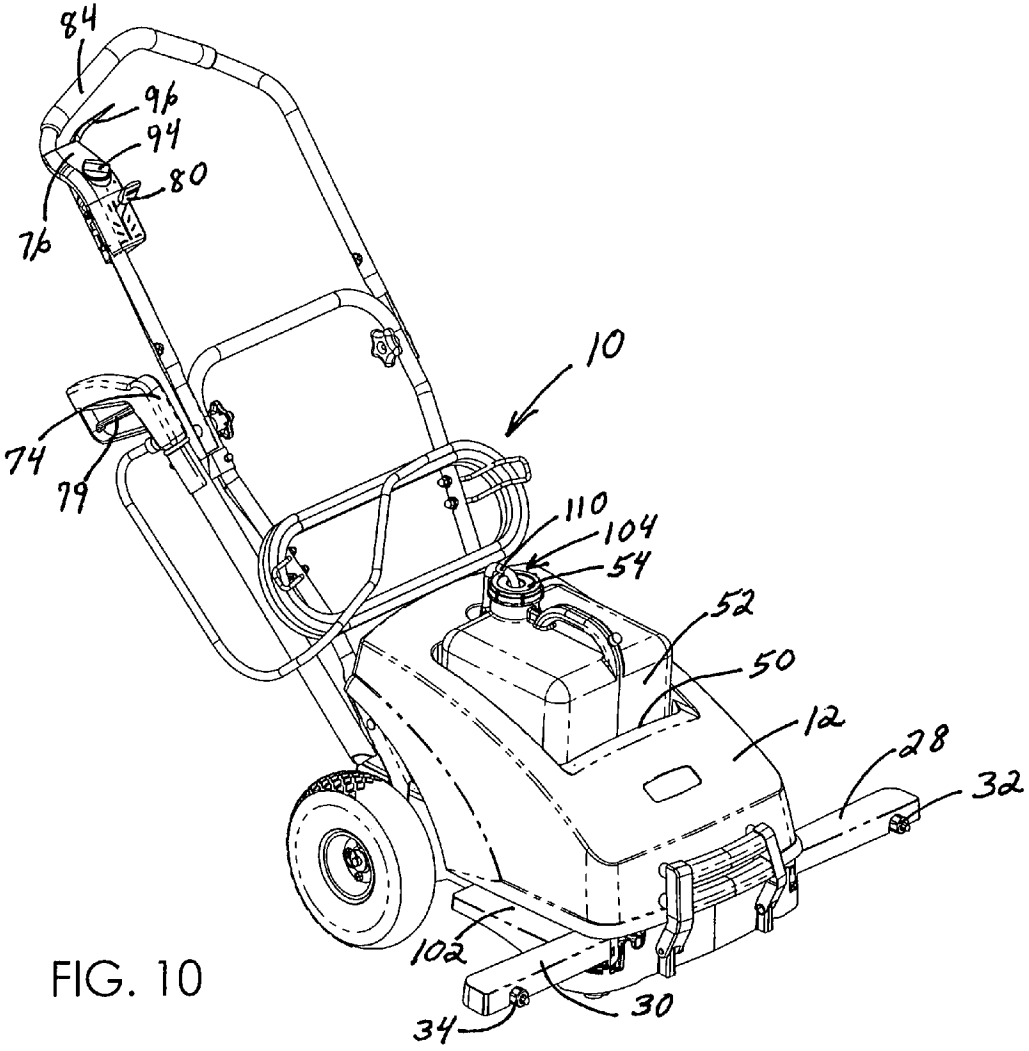
FIG. 10 is a view similar to that of FIG. 1, but showing the booms in their fully extended, outboard positions.

FIG. 10 is a view similar to that of FIG. 1, but the liquid spraying apparatus is shown with booms 28 and 30 in their fully extended, outboard positions. In addition, tank 52 is shown removably mounted through opening 50 in housing 12. With the booms in their fully extended or outboard positions, nozzles 32 and 34 are spaced outwardly from the chassis to their fullest extent, thereby defining the widest spray pattern as the apparatus is moved in a path over a subjacent surface, such as a sidewalk or driveway.

Figure 11:
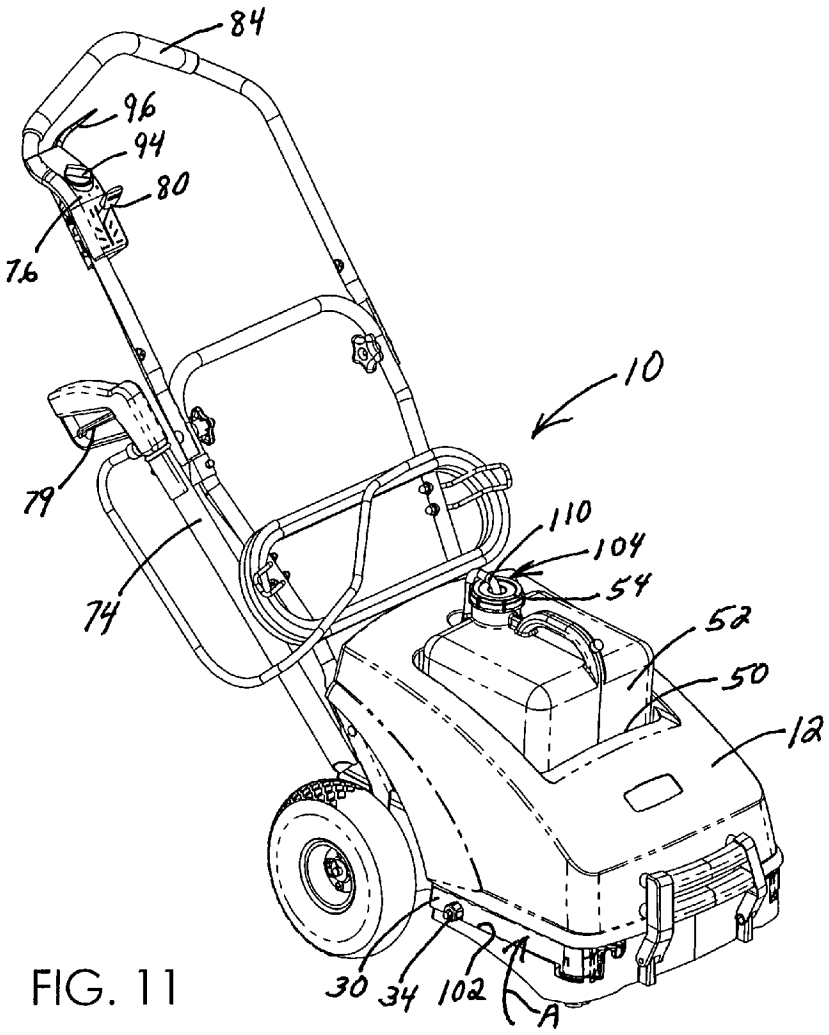
FIG. 11 is a view similar to that of FIG. 10, but showing the booms in their fully retracted, inboard positions.

FIG. 11 shows booms 28 (not visible) and 30 pivoted rearwardly in the direction of arrow "A" to their fully retracted or inboard positions. In the retracted positions, the booms move into recesses 102 alongside the chassis. This would define the narrowest spray pattern as the apparatus is pushed forwardly. In addition, if all of nozzles 32, 34, 36 and 38 are spraying liquid, the amount of liquid sprayed at the edges of the path would be increased. This is desirable because ice/snow has a tendency to build up along the edges of a walkway where there is less traffic.

In comparing FIGS. 10 and 11, along with the above description, it can be seen that booms 28 and 30 are movable in a generally horizontal plane and are pivoted rearwardly from their fully extended/outboard positions to their fully retracted/inboard positions. Therefore, if an operator pushes the spraying apparatus in a forward direction, and one or both of the booms strike a foreign object, the booms can move rearwardly without damaging either the booms or the components to which they are mounted, as described hereinafter.

Figure 12:
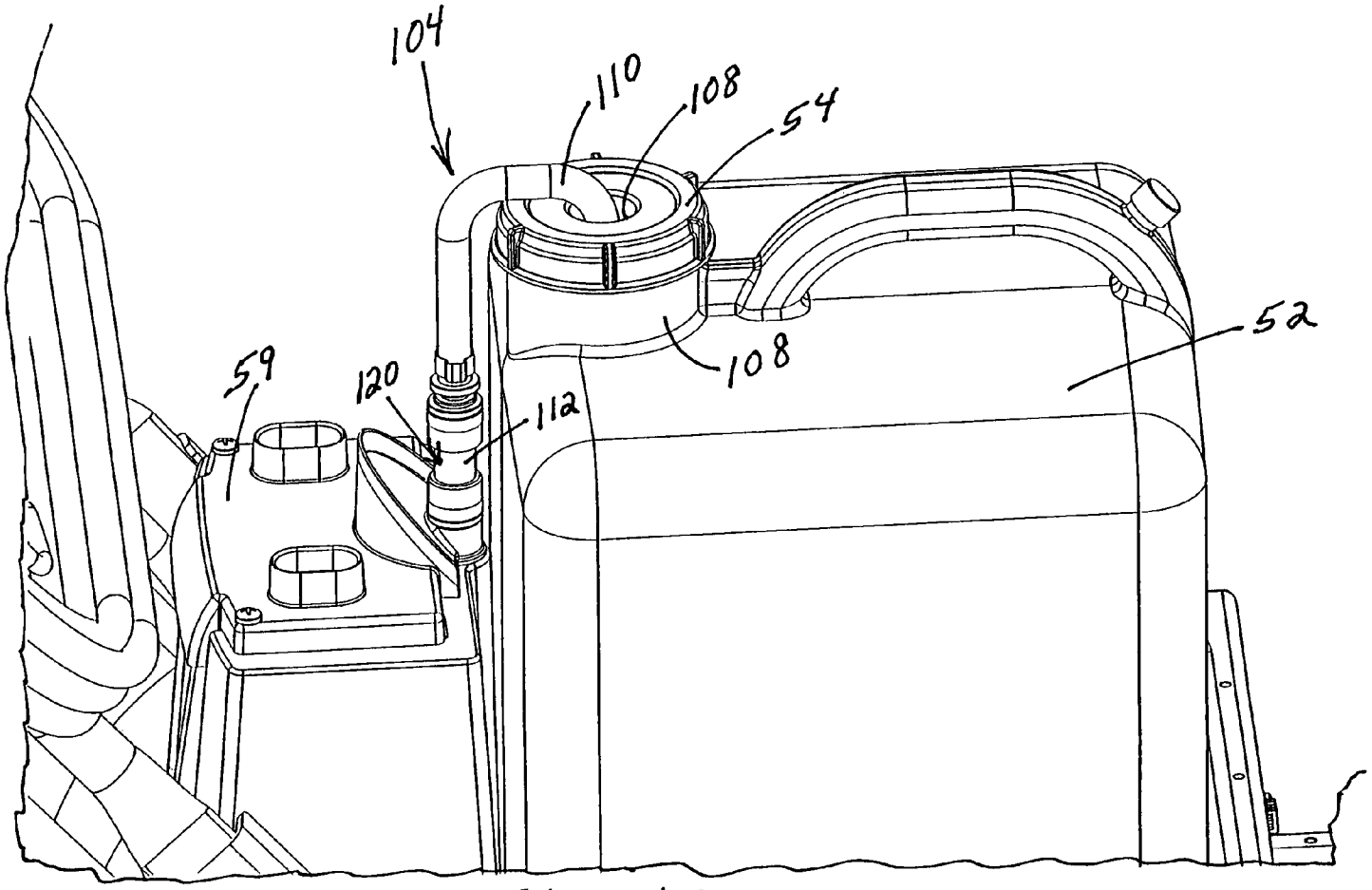
FIG. 12 is an enlarged, fragmented perspective view of the siphon cap and hose assembly mounted between the quick-disconnect coupling means and the tank.
Figure 13:
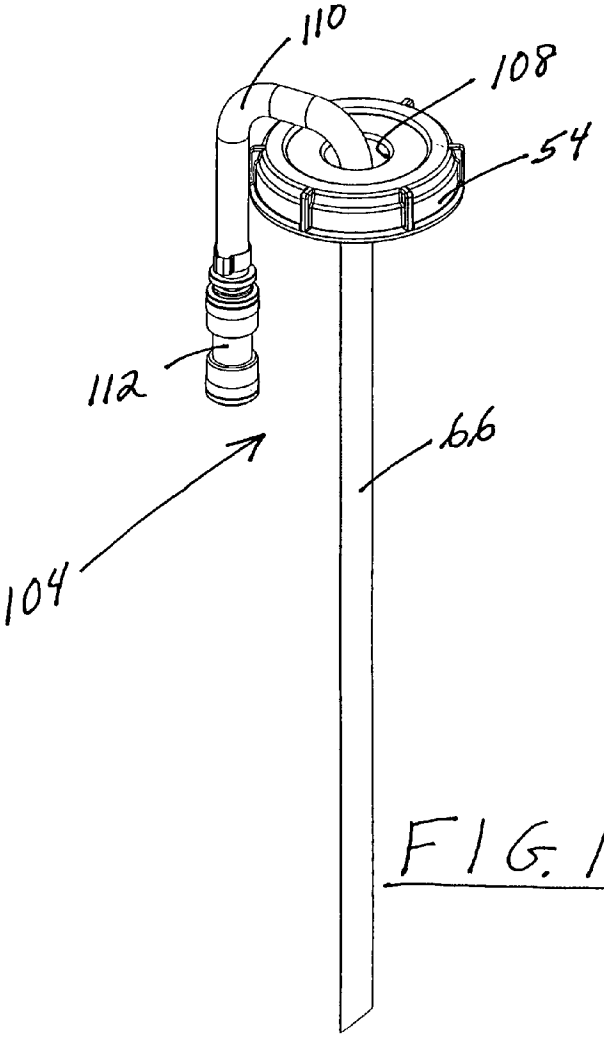
FIG. 13 is a perspective view of the siphon cap and hose assembly separated from the quick-disconnect coupling means and removed from the tank.

Referring to FIGS. 12 and 13, a novel aspect of the invention contemplates the use of a siphon cap and hose assembly, generally designated 104. FIGS. 12 and 13 should be viewed in conjunction with FIGS. 8 and 9, above.

Specifically, the siphon cap and hose assembly 104 includes siphon hose 66 which extends downwardly through a hole 108 in screw cap 54 which is screwed onto a neck 108 (FIG. 12) of tank 52. The siphon hose should extend through hole 108 by a friction fit, or clamps (not shown) can be used to clamp the hose and screw cap together as a self-contained unit or assembly.

Figure 9:
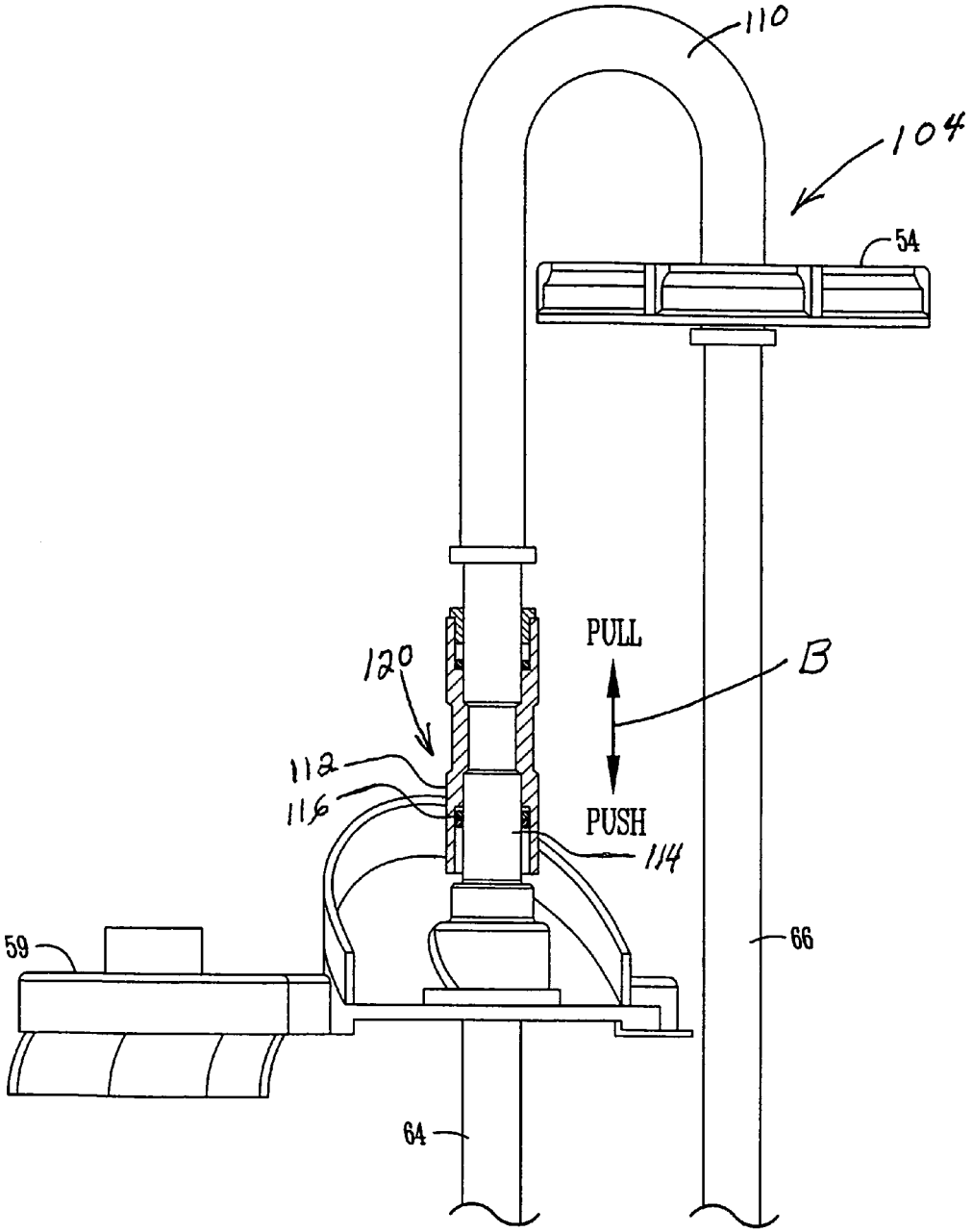
FIG. 9 shows the construction of the quick-disconnect coupling means shown in FIG. 8.

Still referring to FIGS. 8, 9, 12 and 13, siphon hose 66 extends outwardly of screw cap 54 in communication with a hose extension 110. A female coupling 112 is secured to the distal end of the hose extension. The female coupling interengages with a male coupling 114 as best seen in FIG. 9. Double O-rings 116 are seated within female coupling 112 for sealing against the outside of male coupling 114. The male coupling is connected to a feed conduit 64 which leads to the pump as can be seen best in FIG. 8. Therefore, female coupling 112 and male coupling 114 form a quick-disconnect coupling means, generally designated 120, between an outer end of siphon hose 66 and a feed end of conduit 64. The quick-disconnect coupling means is connected and disconnected solely by a generally vertical push-pull action as indicated by double-headed arrow "B" in FIG. 9. No additional releases are incorporated in the coupling means.

From the foregoing, it can be understood that tank 52, along with the siphon cap and hose assembly 104, all can be conjointly removed from the chassis out of opening 50 in housing 12. The quick-disconnect coupling means 104 can be disconnected in a vertical direction as the tank is lifted vertically out of the opening in the housing. This is important because it results in a very minimal dripping of the liquid and contaminating the apparatus when it is desired to remove the tank therefrom. The couplings are self-releasing and will not be damaged as the tank is lifted out of the housing. The siphon hose remains in the tank until the tank is completely separated from the unit and the tank can be refilled at a remote location.

Figure 14:
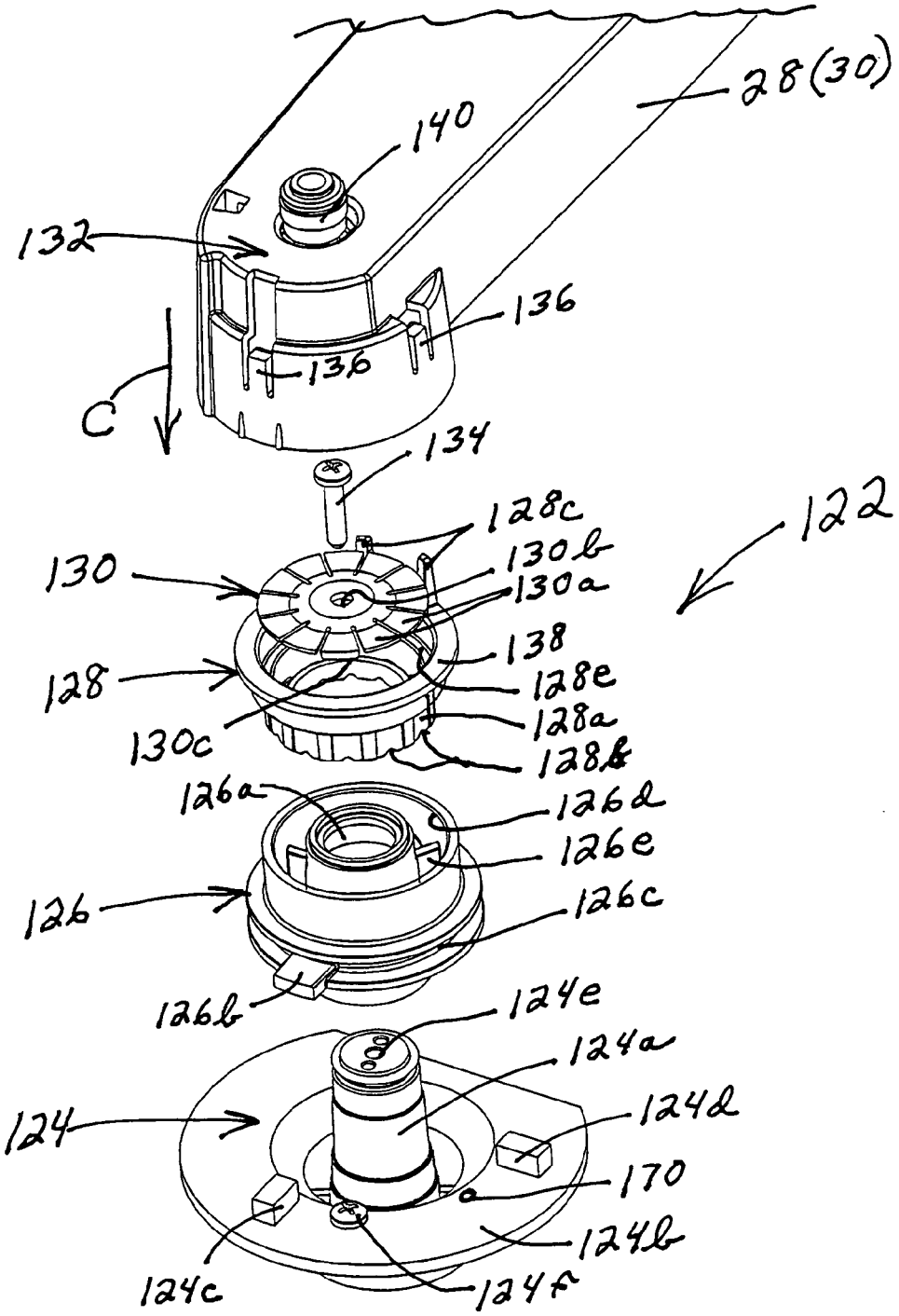
FIG. 14 is an enlarged, perspective view of the components in the hub assembly which pivotally mounts each boom to the chassis, with the boom broken away.
Figure 15:
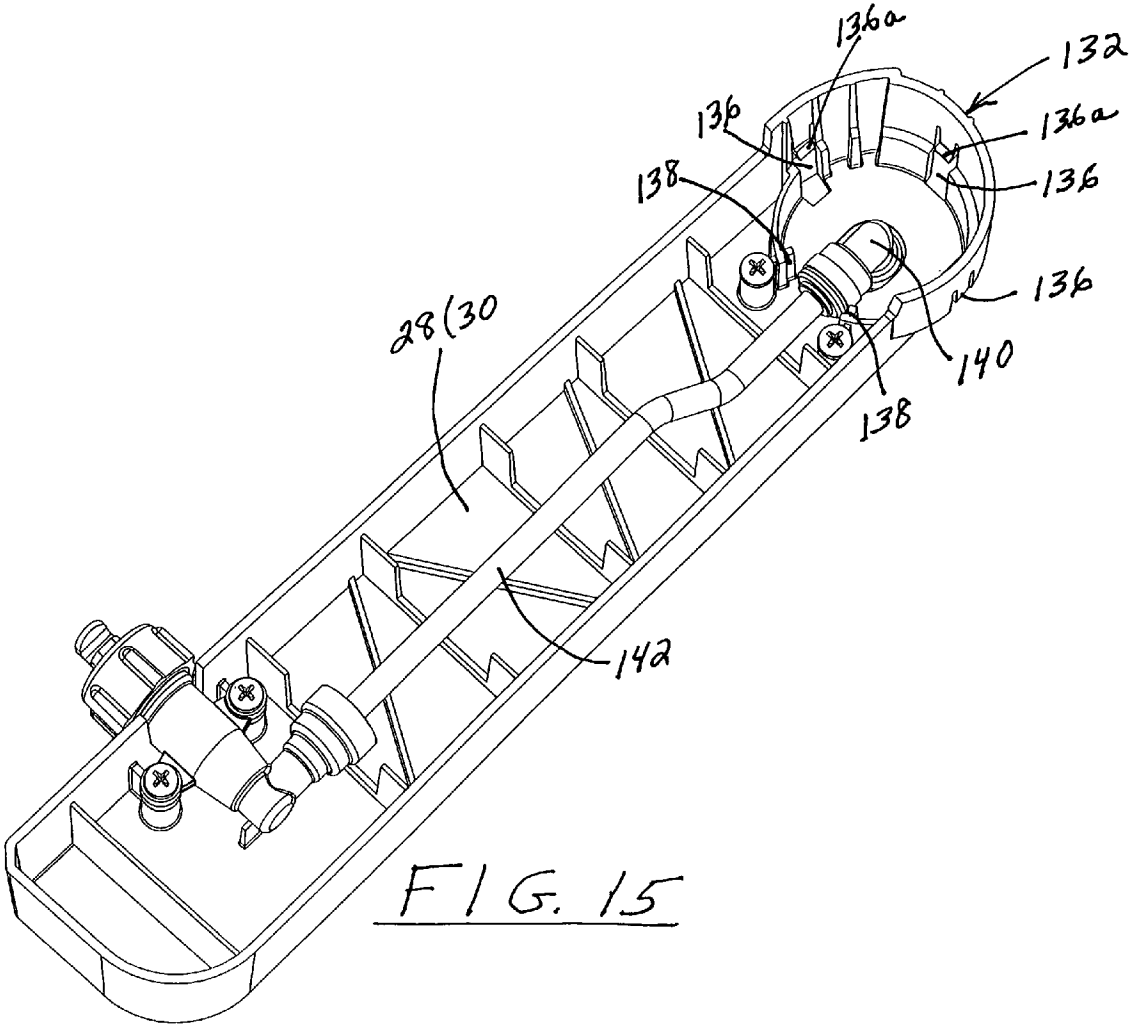
FIG. 15 is an enlarged, perspective view of the underside of one of the booms.

FIGS. 14 and 15 show the construction of a hub assembly, generally designated 122, between an inner end of each boom 28 (30) and the chassis to pivotally mount the boom to the chassis for movement of an outer end of the boom in a generally horizontal plane between an outboard position (FIG. 10) projecting outwardly of the chassis and an inboard position (FIG. 11) generally alongside the chassis. Generally, hub assembly 122 includes a spindle, generally designated 124; a lower hub, generally designated 126; an upper hub, generally designated 128; a spring plate, generally designated 130; and an inner end, generally designated 132, of the respective boom 28 (30).

Specifically, spindle 124 includes an upright spindle post 124*a*. The spindle post can be an integral part of a base portion of the chassis, or the spindle post can extend upwardly of a spindle plate 124*b* which would be appropriately fixed to the chassis. A pair of stop blocks 124*c* and 124*d* are positioned 90° apart on top of the spindle plate. These stop blocks define the limit positions of the boom, i.e., its outboard and inboard positions (90° apart) as described above and shown in FIGS. 10 and 11. Of course, it will depend on whether FIG. 5 represents the left-hand boom or the right-hand boom, but for purposes of illustration, stop block 124*c* represents the retracted or inboard position of the boom and stop block 124*d* represents the extended or outboard position of the boom. For purposes described hereinafter, spindle post 124*a* has a hole 124*e* in its distal end. Although not used in the normal operative mode of the apparatus, a screw 124*f* is shown for purposes also described hereinafter.

Lower hub 126 includes a central opening 126*a* through which spindle post 124*a* projects so that the lower hub can be positioned on top of the spindle plate for rotational movement relative to the spindle post. The lower hub has a radially projecting stop tab 126*b* which projects radially in the space between stop blocks 124*c* and 124*d*. Therefore, the rotational movement of lower hub 126 is limited by stop tab 126*b*. In other words, the lower hub has a rotational action corresponding to the 90° pivotal movement of the boom between its inboard and outboard positions. A peripheral groove 126*c* is formed about lower hub 126 for receiving a flexible cable from the controls of the spraying apparatus. The top of the lower hub has an annular cavity 126*d*, and a plurality (6) of detent ribs 126*e* are provided inside of the annular cavity.

Figure 16:
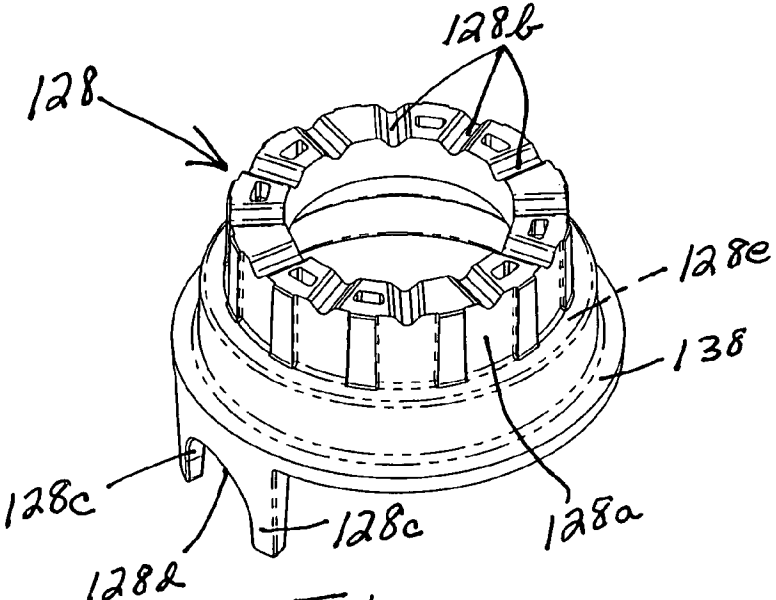
FIG. 16 is an enlarged, perspective view looking at the bottom of the upper hub of the hub assembly shown in FIG. 14.

Referring to FIG. 16 in conjunction with FIG. 14, upper hub 128 is circular and generally hollow. The upper hub has a circular boss 128*a* which is positioned down into annular cavity 126*b* of lower hub 126. The lower circular edge of boss 128*a* has a plurality of detent notches 128*b* which are engageable with the top edges of detent ribs 126*e* of the lower hub. A pair of positioning arms 128*c* project upwardly from the upper hub at the outside edge thereof. The positioning arms define a rounded saddle 128*d* (FIG. 16) therebetween. An interior, circular shoulder 128*e* is formed within the generally hollow upper hub.

Spring plate 130 is disk-shaped and has a plurality of radially extending, generally pie-shaped spring fingers 130*a* about its periphery. The spring plate has a central or axially located hole 130*b* for receiving therethrough a self-tapping clamping screw 134.

Before proceeding with the assembly of boom 28 (30) onto hub assembly 122, the assembly and operation of the hub assembly now will be described. As stated above, lower hub 126 is positioned on top of spindle plate 124*b* by positioning spindle post 124*a* through hole 126*a* in the lower hub. The lower hub is angularly oriented so that stop tab 126*b* of the lower hub is positioned between stop blocks 126*c* and 126*d* on the spindle plate. Circular boss 128*a* of upper hub 28 then is positioned into annular cavity 126*d* of the lower hub, with the lower circular edge of the upper hub which includes detent notches 128*b* resting on top of the upper edges of detent ribs 126*e* of the lower hub. Spring plate 130 then is positioned into the generally hollow upper hub so that the spring plate rests on top of circular shoulder 128*e* of the upper hub. Clamping screw 134 then is positioned downwardly through hole 130*b* in the spring plate and is tapped into hole 124*e* of spindle post 124*a* to hold all of the parts of hub assembly 122 together. Selected ones of the spring fingers 130*a* of the spring plate have downwardly depending flanges 130*c* at their outer edges. These flanges of the selected spring fingers, only engage shoulder 128*e* of upper hub 128. Therefore, the effective spring load of spring plate 130 can be varied by varying the number of spring fingers which are provided with flanges 130*c*. This variable spring load is easily provided by molding spring plate 130 of plastic material.

Once the hub assembly is assembled together as described immediately above, the clamped spring plate 130 is effective to spring-load the assembly with detent notches 128*b* of upper hub 128 being spring-biased against the upper edges of detent ribs 126*e* of the lower hub. Therefore, while the rotation of lower hub 126 relative to the chassis of the spring apparatus is limited by stop tab 126*b* and stop blocks 124*c* and 124*d*, upper hub 128 can be rotated relative to the lower hub under the spring-biased interengagement of detent notches 128 of the upper hub and detent ribs 126*e* of the lower hub. This is important so that the booms can "give" or move relative to the chassis should one of the booms be accidentally engaged with an extraneous object as the spring apparatus is moved during operation. The spring-loaded detent notches 128*b* and detent ribs 126 form a built-in slip clutch to prevent damage to the boom or the hub assembly. In addition, it is known that flexible cables can fail over time or continuous use. The spring-loaded detents can be used to rotate the upper hub and boom relative to the lower hub to reposition the boom so that the extreme positions of the boom precisely correspond to the extreme limit positions defined by stop blocks 124*c* and 124*d*. In fact, in a low cost unit which might eliminate the controls of FIGS. 18 and 19, the spring-loaded detents may comprise the positioning means for the booms of the spraying apparatus. In other words, the slip clutch then would also comprise the positioning means.

The inner end 132 of boom 128 (30) is generally hollow as shown in FIG. 15 which illustrates the underside of the boom. The boom, as well as the components of hub assembly 122, is molded of plastic material. Generally, releasable latch means are provided between the inner end of the boom and the hub assembly to allow the boom to be readily removed for repair or replacement purposes. The latch means also allows the boom to break-away from the hub assembly and the apparatus chassis without damaging the molded components of the hub assembly and the considerable expense of disassembling and reassembling the hub assembly. The releasable latch means also allows the boom to be assembled or pivotally mounted without the use of any tools.

Specifically, the releasable latch means at the end of the boom comprise a plurality (3) of flexible latch arms 136 having latch hooks 136*a* at the distal ends thereof. Once hub assembly 122 is assembled as described above, the inner end 132 of the boom is positioned over the top of the hub assembly and is pushed downwardly in the direction of arrow "C" (FIG. 14) until the latch hooks at the ends of the flexible latch arms 136 snap-latch over a circular or peripheral flange 138 which projects outwardly of the upper hub. The boom can be removed by pulling outwardly on the flexible latch arms to release the latch hooks from engagement with the peripheral flange of the upper hub.

FIG. 15 also shows a pair of positioning ribs 138 molded integrally at the inside of the hollow inner end of the boom. Positioning arms 128*c* of the upper hub were described above in relation to FIGS. 14 and 16. These positioning arms are positioned between positioning ribs 138 of the boom arm while saddle 128*d* (FIG. 16) embraces a fitting 140 on the boom. These positioning arms and positioning ribs are effective to properly position the boom arm relative to upper hub 28. Therefore, the boom becomes integral with the upper hub and moves conjointly with the upper hub between the outboard and inboard positions, precisely as described above as defined by stop tab 126*b* on the lower hub and stop blocks 124*c* and 124*d* on spindle plate 124*b*. Finally, FIG. 15 shows a conduit section 142 which extends between nozzle 32 and fitting 140, with the fitting being shown in FIG. 14 located for connection to the overall conduit means on the spraying apparatus leading to the pump and the liquid tank.

Figure 17:
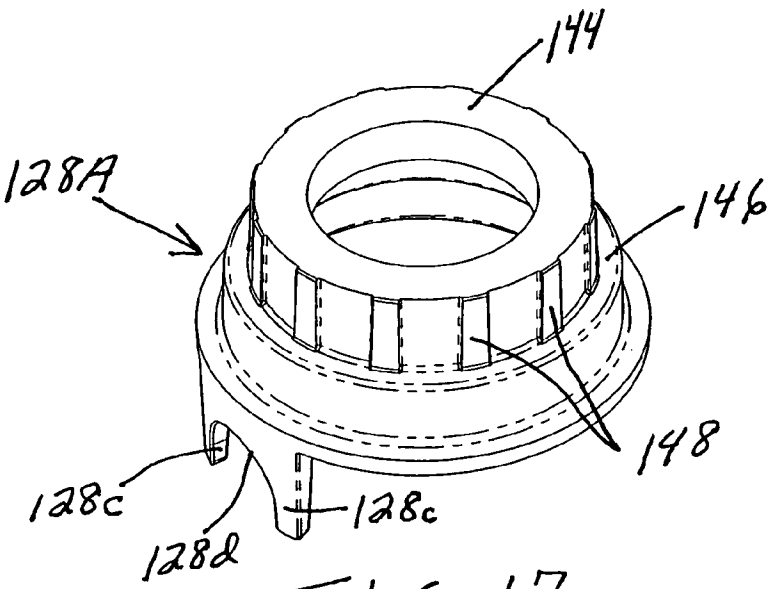
FIG. 17 is a view similar to that of FIG. 16, but of an alternative embodiment.

FIG. 17 shows a modified form of an upper hub, generally designated 128A. The modified upper hub eliminates the detent notches 128*b* of the embodiment shown in FIG. 16.

Those notches have been replaced by a friction surface or end face 144 which engages ribs 126*e* (FIG. 14) of the lower hub. Annular surface 146 and incremented surfaces 148 also can be used as friction surfaces. With the modified upper hub 128*a*, the upper hub is molded with precise dimensions relative to the interior of lower hub 126 so that there is an interference fit between the hubs at friction surfaces 144, 146 and 148 to allow for some forced relative rotation between the hubs without damaging the hubs. The friction surfaces would be held in engagement by the spring-biasing of spring plate 130, as described above as a friction form of a slip clutch.

Figure 18:
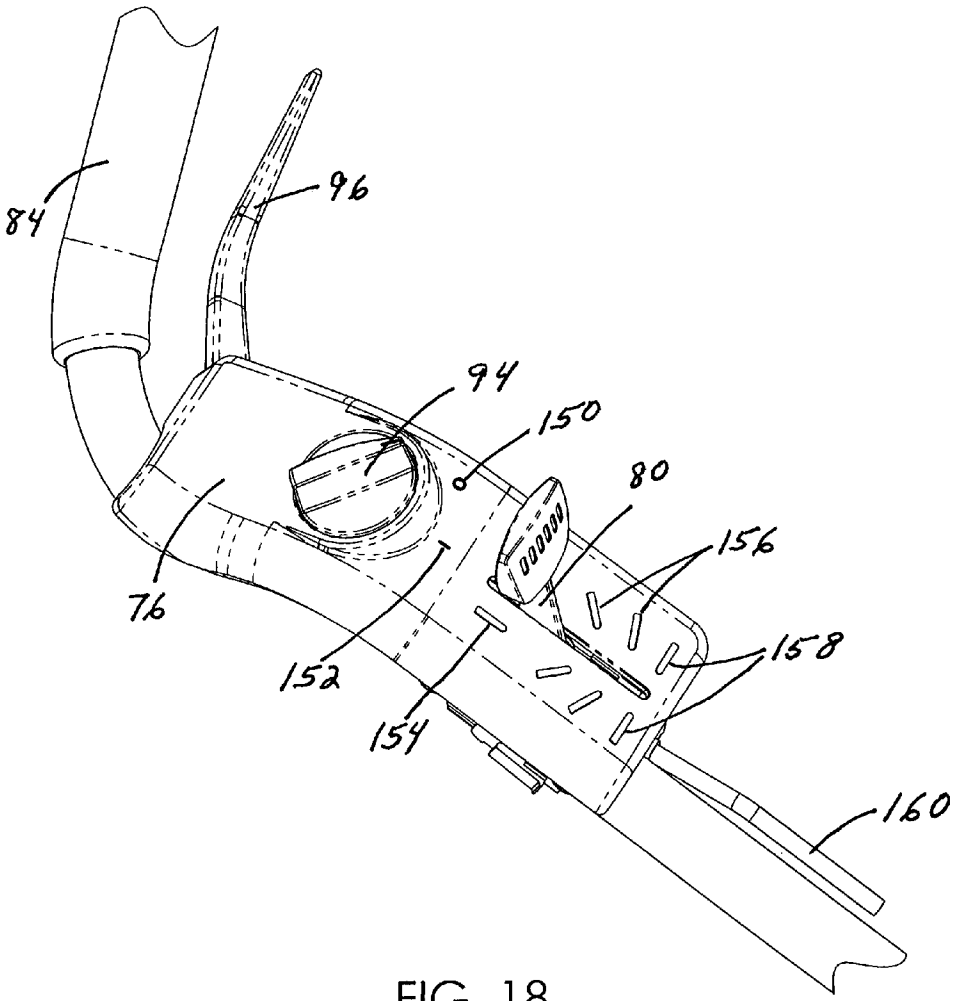
FIG. 18 is an enlarged, fragmented perspective view showing the control housing and an alternative embodiment of the controls of the apparatus.

FIG. 18 shows an enlargement of control housing 76 on handle 84 (FIGS. 1, 10 and 11) and including lever 80, rotary knob 94 and trigger 96, according to an alternative embodiment described below in relation to the control schematics of FIGS. 20 and 21. Specifically, rotary knob 94 is rotatable between an "OFF" position indicated at 150 and an "ON" position indicated at 152. This is a power on/off switch of the spraying apparatus. Indicia 154, 156, and 158 are located in linear paths on control housing 76 along the path of movement of lever 80. Indicia 154 represents the retracted or inboard position of booms 28 and 30. Indicia 156 represents a pair of intermediate position of the booms. Indicia 158 represents the extended or outboard positions (FIG. 10) of the booms. Of course, as stated above, a flexible cable extends between the lever and lower hub 126 (FIG. 14) to effect movement of the booms between these positions corresponding to movement of lever 80 between its positions as represented by indicia 154, 156 and 158.

Figure 19:
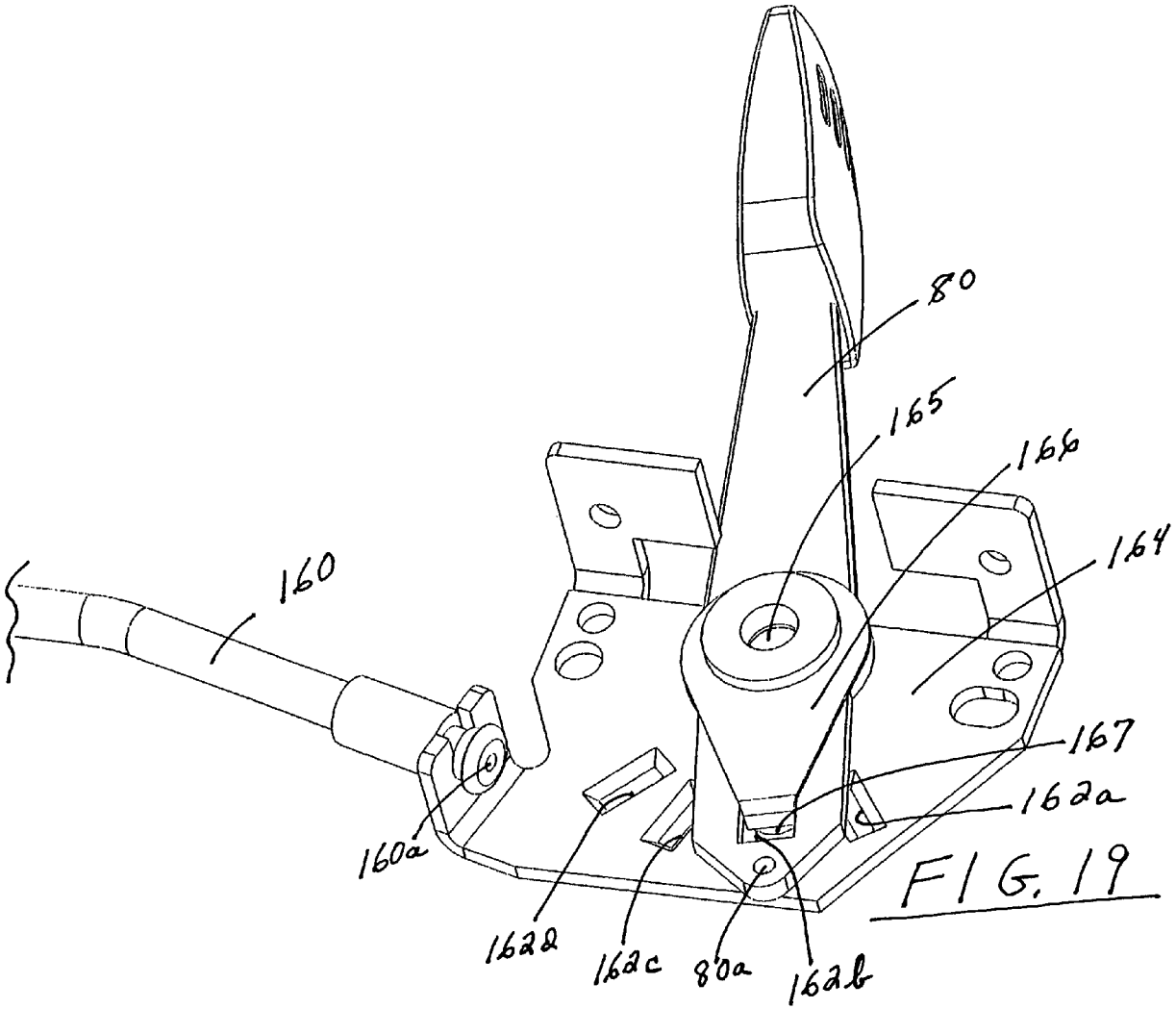
FIG. 19 is an enlarged perspective view of the positioning means for the boom, inside the control housing shown in FIG. 18.

FIG. 19 shows detent means for holding lever 80 in positions corresponding to the inboard, intermediate and outboard positions of the booms and, thereby, holding the booms in those respective positions. Specifically, a flexible cable 160 has an axially movable wire (not shown) as is known in the art. The wire extends out of a hole 160*a* at the outer end of the cable and is secured in a hole 80*a* at an inner end of the lever. Four positioning holes 162*a*, 162*b*, 162*c* and 162*d* are formed in a positioning plate 164. Lever 80 is pivoted to the positioning plate, at 165. Positioning hole 162*a* corresponds to indicia 154 (FIG. 18) on control housing 76 and defines the retracted or inboard positions of the booms. Positioning holes 162*b* and 162*c* correspond to indicia 156 and define the intermediate positions of the booms. Positioning hole 162*d* corresponds to indicia 158 and defines the extended or outboard positions of the booms.

Still referring to FIG. 19, a spring plate 166 is rigidly clamped to lever 80 and includes a positioning detent 167 which is constantly spring-biased against positioning plate 164 and into positioning holes 162*a*-162*d*. FIG. 19 shows lever 80 pivoted to a position whereat positioning detent 167 has "snapped" into positioning hole 162*b*. The solid wire of flexible cable 160 is coupled to a flexible wire (e.g., braided) which is wound in groove 126*c* (FIG. 14) of lower hub 126 of hub assembly 122. Therefore, lever 80 is effective to pivot the booms to one of the intermediate positions. If the lever is pivoted so that positioning detent 167 snaps into either positioning hole 162*a* or 162*d*, the booms will be pivoted to either their inboard or outboard positions, respectively.

Figure 20:
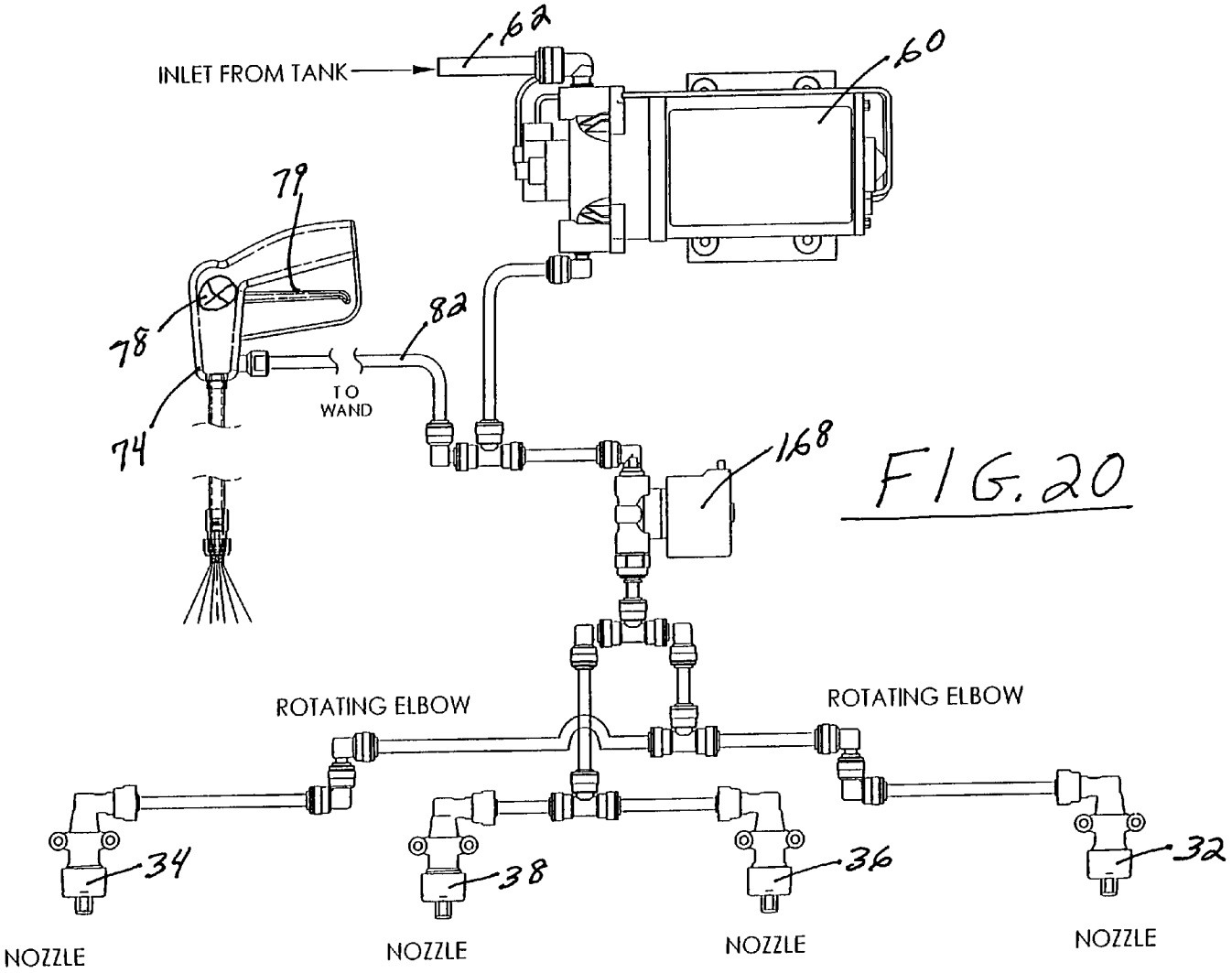
FIG. 20 is a view similar to that of FIG. 6, but of the alternative embodiment.

FIG. 20 shows a schematic diagram of the hydraulics of the alternative embodiment of the invention represented by the controls in FIG. 18. Specifically, in comparing FIG. 20 of the alternative embodiment with the diagram of FIG. 6, it can be seen that solenoid valves 68 and 70 (FIG. 6) have been replaced by a single solenoid valve 168. This solenoid valve is operated by trigger 96 on handle 84, whereby all of nozzles 32, 34, 36 and 38 are rendered operative by the single trigger. Valve 78 on hand wand 74 still is controlled by trigger 79. Similarly, the electrical schematic diagram of FIG. 21 shows the single solenoid valve 168, along with the single trigger switch identified by the trigger reference numeral 96.

Figure 21:
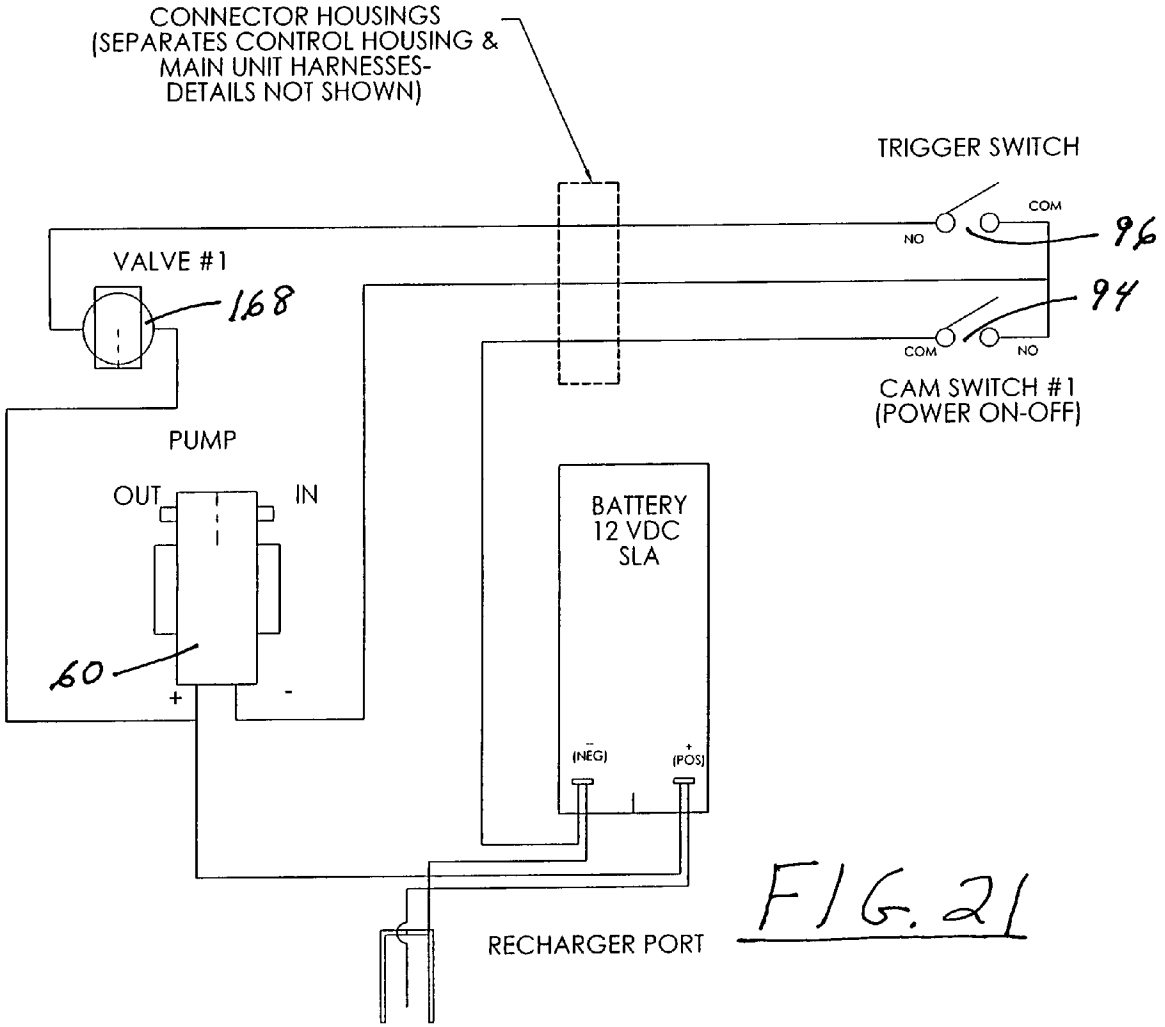
FIG. 21 is a view similar to that of FIG. 7, but of the alternative embodiment.

In operation, power to the spraying apparatus is turned on by rotating rotary knob 94 (FIG. 18) to close the cam switch (94) shown in FIG. 21. This closes a circuit through pump 60 and actuates the pump. When it is desired to spray liquid from nozzles 32-38, trigger switch 96 is actuated to open solenoid 168 to spray liquid from nozzles 36-38. When it is desired to spray liquid from hand wand 74, trigger 79 is actuated to open valve 78 to spray liquid from the wand nozzle. Therefore, an operator can selectively spray liquid from either the boom and chassis nozzles 32-38 or from the wand nozzle, or both, simply by selectively actuating either trigger 96 or trigger 79, respectively, or both.

Lastly, referring back to FIG. 14, screw 124*f* is shown inserted into a pre-drilled hole in spindle plate 124*b* near stop block 124*c*. Alternately, the screw could be inserted into a pre-drilled hole 170 near stop block 124*d*. In the event that the wire of flexible cable 160 breaks and an operator cannot repair the cable, such as the operator not having ready access to a replacement wire or cable, screw 124*f* can be used as a temporary expedient to hold stop tab 126*b* on lower hub 126 against either of the stop blocks and, thereby, hold the booms in either of their outboard or inboard positions, until repairs can be made.

It should be understood that the use of the term "chassis" herein and in the claims hereof is meant to refer to any of the various fixed or supporting components of liquid spraying apparatus 10, including but not limited to the framework of the apparatus, as well as the housing, the battery cover and the handle of the apparatus. For instance, booms 28 and 30 could be pivotally mounted directly to the chassis according to certain aspects of the invention, notwithstanding the fact that in the illustrated embodiment, the booms are mounted to the chassis indirectly through the hub assembly.

In addition, all of the liquid conduit means and electrical wiring are not shown in the drawings to avoid unduly cluttering the depictions and detracting from a clear and concise illustration of the invention.

Boom height and location relative to the ground surface have been selected to reduce spray drift from the nozzles 32, 34, 36 and 38 while still providing desired spray pattern and rate of application. In particular, they have been optimized for balance of pattern, rate, overspray and droplet size, impact, velocity, etc.

Worthy of note is the preferred molded plastic construction of the base and cover and boom mechanics, so that the spraying apparatus 10 will survive in a de-icer environment. There has been outlined in the specification, rather broadly, the more important features of the invention in order that its details may be better understood and appreciated for the present contribution to the art. It is to be understood, however, the invention is not limited in application to the precise details and construction arrangements here set forth, but that modifications can be made to provide other various combinations still achieving the objectives of the present invention. It is also to be realized that optimal dimensional relationships for the parts mentioned to function include variations in size, materials, shape, form, function, and that a variety of different physical components may be used for each of the separate individual elements here described.

With the above foregoing description of preferred embodiments in mind and the description of the essential features set forth, the invention is claimed as follows.

The invention claimed is:

1. A liquid spraying apparatus, comprising:

a chassis having a front, a rear, opposite sides and a handle generally at the rear of the chassis;

wheel means for moving the spraying apparatus in a path over a subjacent surface;

a tank mounted on the chassis for holding liquid to be sprayed;

at least one first spray nozzle on the chassis and including a first manually actable trigger operatively associated therewith to effect spraying liquid therefrom;

a hand spray wand having a second spray nozzle and a second manually actuable trigger operative associated therewith to effect spraying liquid de-icer therefrom; and conduit means for feeding liquid from the tank to the first and second spray nozzles, whereby the liquid can be selectively sprayed from either the first spray nozzle on the chassis or the second spray nozzle on the hand wand, or both, by selectively actuating either the first trigger or the second trigger, respectively, or both.

2. The liquid spraying apparatus of claim 1, including a pump for pumping the liquid from the tank to the nozzles, and first and second valve means in said conduit means and operatively associated with the first and second triggers, respectively, to open and close the conduit means to the first and second nozzles, respectively.

3. The liquid spraying apparatus of claim 1 wherein said first spray nozzle is mounted on a boom pivotally mounted on the chassis and movable therewith.

4. The liquid spraying apparatus of claim 1 wherein said first spray nozzle is a fixed nozzle mounted directly on the chassis.

5. A liquid spraying apparatus, comprising:

a chassis;

a tank removable mounted on the chassis for holding liquid to be sprayed, the tank having a fill opening;

a nozzle on the chassis for spraying liquid therefrom;

conduit means for feeding liquid from the tank to the nozzle;

a siphon cap and hose assembly including a cap for closing the fill opening of the tank, and a siphon hose having an outer end and an inner end extending through the cap into the tank for withdrawing liquid therefrom; and a quick-disconnect coupling means between the outer end of the siphon hose and a feed end of the conduit means whereby the tank and the siphon cap and hose assembly all can be conjointly removed from the chassis as a unit when it is necessary to refill or clean the tank.

6. The liquid spraying apparatus of claim 5 wherein said quick-disconnect coupling means comprise complementary interengageable male and female couplings.

7. The liquid spraying apparatus of claim 6 wherein said male and female couplings are structured to be interengageable solely by a push-pull action.

8. The liquid spraying apparatus of claim 7 wherein the coupling at the feed end of the conduit means is oriented on the chassis whereby the coupling means is connected and disconnected in a generally vertical push-pull direction.

9. A liquid spraying apparatus, comprising:

a chassis having a front, a rear, opposite sides and a handle generally at the rear of the chassis;

wheel means for moving the spraying apparatus in a path over a subjacent surface;

a tank mounted on the chassis for holding liquid to be sprayed;

an elongated spray boom mounted at least at one side of the chassis, with an inner end of the boom pivotally mounted to the chassis for movement of an outer end of the boom in a generally horizontal plane between an outboard position projecting outwardly of the chassis and an inboard position generally alongside the chassis;

at least one spray nozzle on the boom;

conduit means for feeding liquid from the tank to the nozzle;

positioning means for holding the boom in at least one intermediate position between said outboard and inboard positions to vary the width of the spray pattern as the apparatus is moved in the path over the subjacent surface;

a first release mechanism in the form of a slip clutch for overriding said positioning means; and a second release mechanism, independent of the first release mechanism, in the form of a quick release latch means to allow the entire boom to be readily removed from the chassis.

10. The liquid spraying apparatus of claim 9 wherein said boom is pivotally mounted to the chassis by a hub, and both said first and second release mechanisms are incorporated in the hub.

11. The liquid spraying apparatus of claim 9 wherein said slip clutch includes means to hold the boom in an infinite number of intermediate positions between said outboard and inboard positions.

12. The liquid spraying apparatus of claim 9 wherein said quick release latch means is constructed for removal of the boom from the chassis in the outboard position, the inboard position or any position therebetween.

13. The liquid spraying apparatus of claim 12 wherein said quick release latch means comprise snap latch means to allow the boom to be pivotally mounted without tools.

14. The liquid spraying apparatus of claim 13 wherein said snap latch means comprise at least one flexible latch arm.

15. The liquid spraying apparatus of claim 14 wherein said flexible latch arm is fabricated of frangible plastic material so that the latch arm will break under the influence of excessive external forces on the boom arm and, thereby, prevent damage to other parts of the apparatus.

16. The liquid spraying apparatus of claim 9 wherein said boom is pivotally mounted to the chassis by a hub, and said first release mechanism is incorporated in the hub.

17. The liquid spraying apparatus of claim 9 wherein said boom is pivotally mounted to the chassis by a hub, and said second release mechanism is incorporated in the hub.

* * * * *